US009859050B2

(12) United States Patent
Chuang

(10) Patent No.: US 9,859,050 B2
(45) Date of Patent: Jan. 2, 2018

(54) METHOD FOR PRODUCING MAGNETIC ELEMENT WITH TWO MAGNETIC CORES FOR INCREASING COILING SPACE AND MAGNETIC ELEMENT THEREOF

(71) Applicant: CYNTEC CO., LTD., Hsinchu (TW)

(72) Inventor: Chia-Cheng Chuang, Hsinchu (TW)

(73) Assignee: CYNTEC CO., LTD., Hsinchu (TW)

( * ) Notice: Subject to any disclaimer, the term of this patent is extended or adjusted under 35 U.S.C. 154(b) by 0 days.

(21) Appl. No.: 14/972,027

(22) Filed: Dec. 16, 2015

(65) Prior Publication Data

US 2017/0069419 A1 Mar. 9, 2017

(30) Foreign Application Priority Data

Sep. 8, 2015 (CN) ..... 2015 1 0564685

(51) Int. Cl.

| | |
|---|---|
| ***H01F 27/06*** | (2006.01) |
| ***H01F 27/02*** | (2006.01) |
| ***H01F 27/28*** | (2006.01) |
| ***H01F 27/29*** | (2006.01) |
| ***H01F 27/24*** | (2006.01) |

(Continued)

(52) U.S. Cl.

CPC ..... *H01F 27/2828* (2013.01); *H01F 27/06* (2013.01); *H01F 27/24* (2013.01); *H01F 27/29* (2013.01); *H01F 41/02* (2013.01); *H01F 41/06* (2013.01); *H01F 2027/065* (2013.01)

(58) Field of Classification Search

CPC ..... H01F 27/2828; H01F 27/06; H01F 27/24; H01F 27/29; H01F 27/2823; H01F 27/292; H01F 41/02; H01F 41/06; H01F 2027/065; H01F 17/045

USPC ..... 336/212, 170, 192, 83, 65

See application file for complete search history.

(56) References Cited

U.S. PATENT DOCUMENTS 7,948,350 B2 * 5/2011 Shoji ..... H01F 3/10 336/141
8,937,522 B2 * 1/2015 Lai ..... H01F 27/29 336/192
2001/0038327 A1 11/2001 Aoki (Continued)

FOREIGN PATENT DOCUMENTS

CN 1318852 A 10/2001
CN 203338897 U 12/2013

(Continued)

*Primary Examiner* — Mangtin Lian
(74) *Attorney, Agent, or Firm* — Winston Hsu

(57) ABSTRACT

A magnetic element includes a first magnetic core, a second magnetic core and a plurality of conducting wires. The first magnetic core includes a first coiling body, a first protruding portion and a second protruding portion. The second magnetic core includes a second coiling body, a third protruding portion and a fourth protruding portion. A soldering surface of the first protruding portion is parallel and next to a soldering surface of the fourth soldering surface. Since an extension direction of the first magnetic core is extended from the soldering surface of the first protruding portion, an extension direction of the second magnetic core is extended from the soldering surface of the second protruding portion, and the plurality of conducting wires can be coiled on the first and the second coiling bodies respectively, the transformer can provide more space for coiling than the prior art.

17 Claims, 17 Drawing Sheets

(51) Int. Cl.
*H01F 41/02* (2006.01)
*H01F 41/06* (2016.01)

(56) References Cited

U.S. PATENT DOCUMENTS

| | | | | |
|---|---|---|---|---|
| 2009/0273426 | A1 | 11/2009 | Urabe | |
| 2014/0139313 | A1 | 5/2014 | Zhou | |
| 2014/0154920 | A1* | 6/2014 | Dinh | H01F 27/2823<br>439/620.01 |
| 2014/0292464 | A1* | 10/2014 | Takagi | H01F 27/29<br>336/192 |
| 2014/0292465 | A1 | 10/2014 | Takagi | |
| 2014/0292467 | A1 | 10/2014 | Tai | |
| 2015/0228397 | A1 | 8/2015 | Sorel | |

FOREIGN PATENT DOCUMENTS

| | | | |
|---|---|---|---|
| CN | 203456223 | U | 2/2014 |
| CN | 203536151 | U | 4/2014 |
| TW | 201123225 | A1 | 7/2011 |
| TW | I459415 | B | 11/2014 |

* cited by examiner

METHOD FOR PRODUCING MAGNETIC ELEMENT WITH TWO MAGNETIC CORES FOR INCREASING COILING SPACE AND MAGNETIC ELEMENT THEREOF

BACKGROUND OF THE INVENTION

1. Field of the Invention

This invention relates to a magnetic element, especially a magnetic element with two magnetic cores for increasing space for coiling.

2. Description of the Related Art

In prior art, wires of a magnetic element are usually coiled on one magnetic core of a plurality of magnetic cores, and the coiling body of the magnetic core is parallel to the soldering surface of the magnetic element. Therefore, the length of the coiling body is limited by the electrodes on the soldering surface, and the space for accommodating the coiling wires is also limited when coiling the wires on the coiling body of the magnetic element.

When wires of the magnetic element are operated with high currents and high inner resistance, the temperature of the magnetic core of the magnetic element also increases. FIG. 1 shows a relation between the magnetic permeability of the magnetic element and its temperature. According to FIG. 1, when the temperature of the magnetic core reaches the Curie temperature (ex., the Curie temperature of a high magnetically conductive material of Ni—Zn Ferrite may be about 110° C.), the magnetic core may nearly lose its magnetic permeability, namely, the magnetic permeability of the magnetic core may be as low as the magnetic permeability of air. Therefore, inductance of the magnetic element may decrease and the output signal of the magnetic element may be distorted significantly. Furthermore, when the temperature of the magnetic element goes too high, such as even higher than the Curie temperature, the outer insulation layer of the wires may be softened, causing the magnetic element to be short circuited or lacking of voltage endurance.

According to experimental results, to ensure the magnetic element can be operated normally under 70° C., wires with greater diameter can be used. For example, wires with diameter over 90 μm (about two times greater than the diameter of traditional wires) may be used to prevent the temperature of the magnetic core from reaching the Curie temperature. However, to generate the same inductance, the wires with greater diameter must require more space than wires with smaller diameter require for accommodating the same number of coils. Although the greater length of the magnetic core may increase the space for coiling, the footprint of the magnetic element may have to be changed accordingly, causing the issue of hardware incompatibility. Therefore, how to adopt the wires with greater diameter to prevent the wires and the magnetic core from reaching high temperature while preserving the inductance, the area and the footprint of the magnetic element has become an issue to be solved.

SUMMARY OF THE INVENTION

One embodiment of the present invention discloses a magnetic element. The magnetic element includes a first magnetic core, a second magnetic core, a plurality of wires, a plurality of electrodes, and a plurality of connection nodes. The first magnetic core includes a first coiling body, a first protruding portion connected to a first terminal of the first coiling body, and a second protruding portion connected to a second terminal of the first coiling body. The first protruding portion has a first soldering surface. The second magnetic core includes a second coiling body disposed in parallel to the first coiling body, a third protruding portion connected to a first terminal of the second coiling body and a fourth protruding portion connected to a second terminal of the second coiling body. The third protruding portion is disposed adjacent to the second protruding portion. The fourth protruding portion is disposed adjacent to the first protruding portion and has a second soldering surface in parallel to the first soldering surface. Each of the plurality of wires is coiled on the first coiling body or the second coiling body. Each of the plurality of electrodes is disposed on the first soldering surface of the first protruding portion or the second soldering surface of the fourth protruding portion. Each of the plurality of connection nodes is disposed on the second protruding portion or the third protruding portion. An extension direction of the first coiling body is towards away from the first soldering surface, and an extension direction of the second coiling body is towards away from the second soldering surface. The plurality of wires are coiled on the first coiling body along the extension direction of the first coiling body or coiled on the second coiling body along the extension direction of the second coiling body. The first coiling body and the second coiling body are magnetically conductive.

Another embodiment of the present invention discloses a method for producing a magnetic element. The method includes disposing a first electrode, a second electrode, a third electrode and a fourth electrode on a first protruding portion of a first magnetic core, disposing a fifth electrode, a sixth electrode, a seventh electrode and an eighth electrode on a fourth protruding portion of a second magnetic core corresponding to positions of the fourth electrode, the third electrode, the second electrode and the first electrode respectively, disposing a first connection node, a second connection node, a third connection node and a fourth connection node on a second protruding portion of the first magnetic core corresponding to the positions of the fourth electrode, the third electrode, the second electrode and the first electrode respectively, and disposing a fifth connection node, a sixth connection node, a seventh connection node and an eighth connection node on a third protruding portion of the second magnetic core corresponding to positions of the fourth connection node, the third connection node, the second connection node and the first connection node respectively. The second electrode is disposed between the first electrode and the third electrode, and the third electrode is disposed between the second electrode and the fourth electrode.

The method further includes electrically coupling a terminal of a first wire and a terminal of a fourth wire to the first electrode and the fourth electrode respectively, spinning the first magnetic core with respect to a first spinning direction to coil the first wire and the fourth wire on a first coiling body of the first magnetic core, electrically coupling another terminal of the first wire and another terminal of the fourth wire to the fourth connection node and the first connection node respectively, electrically coupling a terminal of a second wire and a terminal of a third wire to the second electrode and the third electrode respectively, spinning the first magnetic core with respect to a second spinning direction opposite to the first spinning direction to coil the second wire and the third wire on the first coiling body of the first magnetic core, electrically coupling another terminal of the second wire and another terminal of the third wire to the third connection node and the second connection node respectively, electrically coupling a terminal of a fifth wire and a terminal of a eighth wire to the fifth connection node and the eighth connection node respectively, spinning the second magnetic core with respect to the first spinning direction to coil the fifth wire and the eighth wire on a second coiling body of the second magnetic core, electrically coupling another terminal of the fifth wire and another terminal of the eighth wire to the eighth electrode and the fifth electrode respectively, electrically coupling a terminal of a sixth wire and a terminal of a seventh wire to the sixth connection node and the seventh connection node respectively, spinning the second magnetic core with respect to the second spinning direction to coil the sixth wire and the seventh wire on the second coiling body of the second magnetic core, electrically coupling another terminal of the sixth wire and another terminal of the seventh wire to the seventh electrode and the sixth electrode respectively, connecting the first magnetic core and the second magnetic core with a manner of standing side by side, electrically coupling the first connection node to the eighth connection node, electrically coupling the second connection node to the seventh connection node, electrically coupling the third connection node to the sixth connection node, and electrically coupling the fourth connection node to the fifth connection node.

Another embodiment of the present invention discloses a method for producing a magnetic element. The method includes disposing a first electrode, a second electrode, a third electrode and a fourth electrode on a first protruding portion of a first magnetic core, and disposing a first connection node, a second connection node, a third connection node and a fourth connection node on a second protruding portion of the first magnetic core. The second electrode is disposed between the first electrode and the fourth electrode, and the fourth electrode is disposed between the second electrode and the third electrode. The second connection node is disposed between the first connection node and the fourth connection node, and the fourth connection node is disposed between the second connection node and the third connection node.

The method further includes electrically coupling a terminal of a first wire and a terminal of a fourth wire to the first electrode and the fourth electrode respectively, spinning the first magnetic core with respect to a first spinning direction to coil the first wire and the fourth wire on a first coiling body of the first magnetic core, electrically coupling another terminal of the first wire and another terminal of the fourth wire to the fourth connection node and the first connection node respectively, electrically coupling a terminal of a second wire and a terminal of a third wire to the second electrode and the third electrode respectively, spinning the first magnetic core with respect to a second spinning direction opposite to the first spinning direction to coil the second wire and the third wire on the first coiling body of the first magnetic core, and electrically coupling another terminal of the second wire and another terminal of the third wire to the third connection node and the second connection node respectively.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
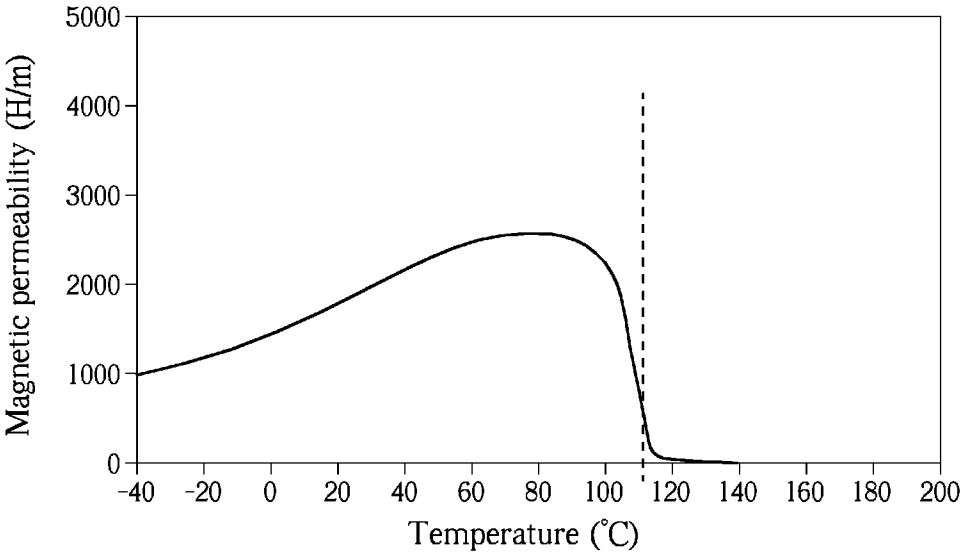
FIG. 1 shows a relation between a magnetic permeability of a magnetic element and temperature of the magnetic element.
Figure 2:
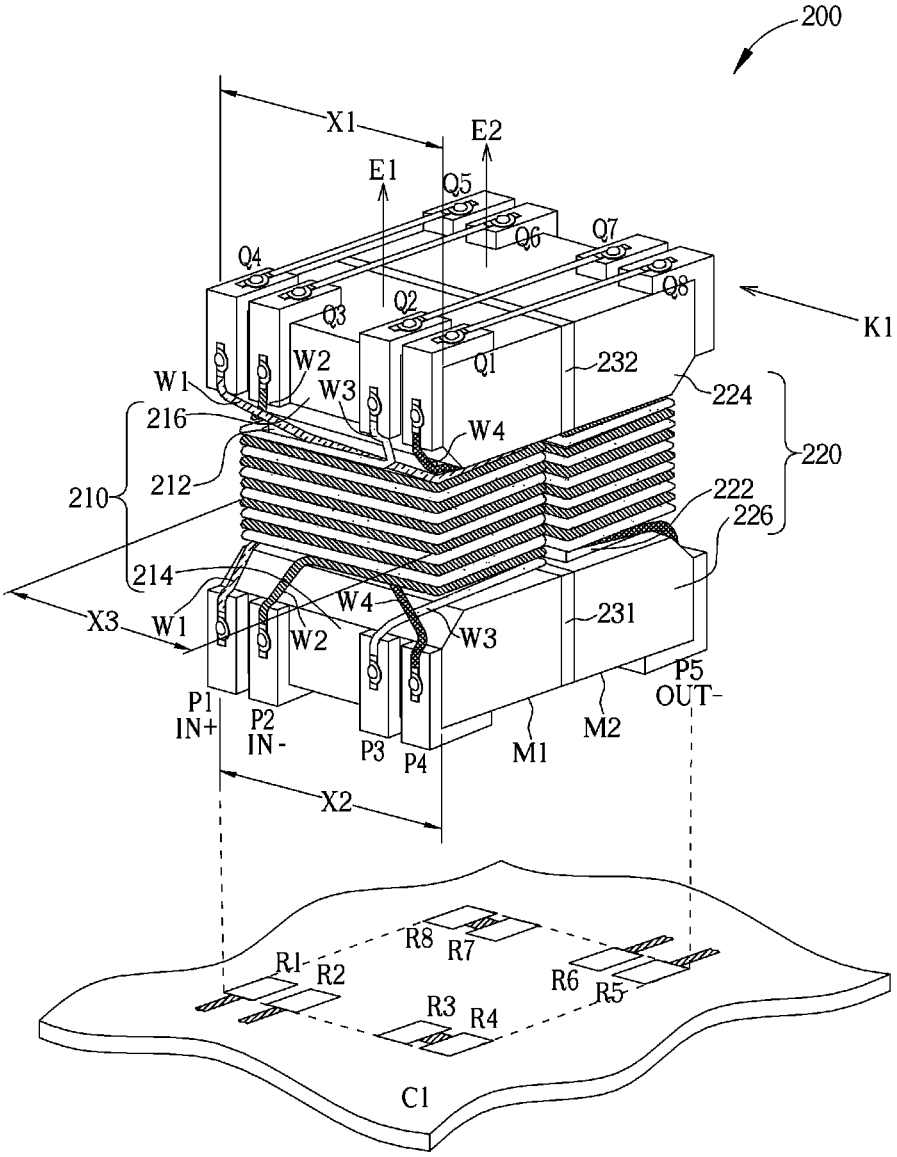
FIG. 2 shows a magnetic element from a first view according to one embodiment of the present invention.
Figure 3:
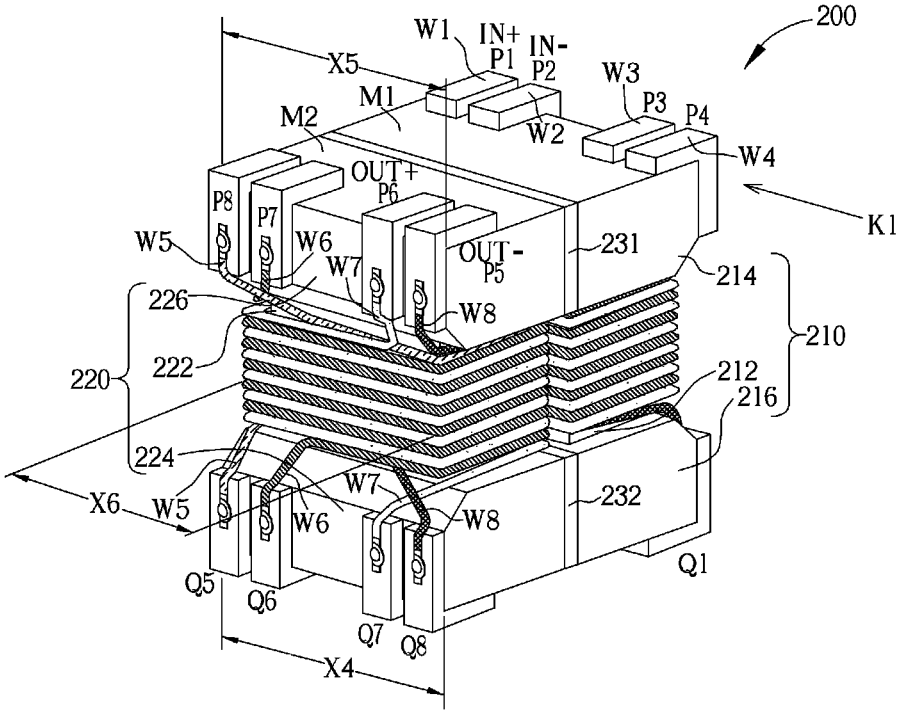
FIG. 3 shows the magnetic element in FIG. 2 from a second view.

FIG. 2 shows a magnetic element 200 from a first view according to one embodiment of the present invention, and FIG. 3 shows the magnetic element 200 from a second view. The magnetic element 200 includes a first magnetic core 210, a second magnetic core 220, a plurality of wires, a plurality of electrodes, and a plurality of connection nodes. The first magnetic core 210 includes a first coiling body 212, a first protruding portion 214, and a second protruding portion 216. The second magnetic core 220 includes a second coiling body 222, a third protruding portion 224, and a fourth protruding portion 226. The wires on the first magnetic core 210 and the second magnetic core 220 may be electrical coupled to each other through the connection nodes, and may be coupled to external circuits through the electrodes.

In the present invention, the magnetic element 200 can include a first electrode P1 to an eighth electrode P8 and a first connection node Q1 to an eighth connection node Q8.

The first electrode P1 to the eighth electrode P8 and the first connection node Q1 to the eighth connection node Q8 can be L-shaped lead frame glued on the corresponding protrusion portions with adhesive, or formed by electroplating or coating, or conductive metal paste, such as silver (Ag) paste.

The first coiling body 212 and the second coiling body 222 are magnetically conductive. In some embodiments, the first protruding portion 214, the second protruding portion 216, a third protruding portion 224 and a fourth protruding portion 226 can all be made of the same material as the first coiling body 212 and the second coiling body 222 is made of, so that the protruding portions 214, 216, 224, and 226 are also magnetically conductive. The first magnetic core 210 and the second magnetic core 220 can be made of soft magnetic materials, such as Mn—Zn Ferrite, Ni—Zn Ferrite and/or ferrite. Also, since the Ni—Zn Ferrite is highly magnetically conductive and has high Curie temperature (up to 110° C.), it can be adopted by the magnetic element of the present invention for enhancing the ability of temperature endurance and making the magnetic element suitable for high temperature environment.

The first protruding portion 214 is connected to a first terminal 212A (shown in FIG. 4) of the first coiling body 212, and the first protruding portion 214 has a first soldering surface M1. The second protruding portion 216 is connected to a second terminal 212B (shown in FIG. 4) of the first coiling body 212 opposite to the first terminal 212A so that the first protruding portion 214 and the second protruding portion 216 are facing each other. The first electrode P1 to the fourth electrode P4 can be disposed on the first soldering surface M1 of the first protruding portion 214, and the first connection node Q1 to the fourth connection node Q4 can be disposed on the second protruding portion 216. The first coiling body 212 and the second coiling body 222 can be disposed in parallel to each other. The third protruding portion 224 is connected to a first terminal 222A (shown in FIG. 4) of the second coiling body 222, and can be adjacent to the second protruding portion 216. The fourth protruding portion 226 is connected to a second terminal 222B (shown in FIG. 4) of the second coiling body 222 adjacent to the first protruding portion 214, and the fourth protruding portion 226 has a second soldering surface M2 parallel to the first soldering surface M1. In FIGS. 2 and 3, the first protruding portion 214 and the fourth protruding portion 226 can be connected by the adhesive 231, and the second protruding portion 216 and the third protruding portion 224 can be connected by the adhesive 232. The fifth connection node Q5 to the eighth connection node Q8 can be disposed on the third protruding portion 224, and the fifth electrode P5 to the eighth electrode P8 can be disposed on the second soldering surface M2 of the fourth protruding portion 226.

When observing the first protruding portion 214 and the second protruding portion 216 from the first view in FIG. 2, the fourth electrode P4, the third electrode P3, the second electrode P2 and the first electrode P1 are arranged sequentially on the first protruding portion 214 along a disposing direction K1 in parallel to the first soldering surface M1. The first connection node Q1, the second connection node Q2, the third connection node Q3 and the fourth connection node Q4 are arranged sequentially on the second protruding portion 216 along the disposing direction K1. When observing the third protruding portion 224 from the first view in FIG. 2, the eighth connection node Q8, the seventh connection node Q7, the sixth connection node Q6 and the fifth connection node Q5 are arranged sequentially on the third protruding portion 224 along the disposing direction K1 parallel to the second soldering surface M2. When observing the second soldering surface M2 of the fourth protruding portion 226 from the second view in FIG. 3, the fifth electrode P5, the sixth electrode P6, the seventh electrode P7 and the eighth electrode P8 are arranged sequentially on the fourth protruding portion 226 along the disposing direction K1. The disposing direction K1 is extending from a side of a protruding portion of the protruding portions 214, 216, 224, and 226 to another side of the protruding portion.

Since the first soldering surface M1 is adjacent and parallel to the second soldering surface M2, when trying to solder the first electrode P1 to the eighth electrode P8 of the magnetic element 200 to the system printed circuit board C1, the soldering process can be completed by putting the first soldering surface M1 and the second soldering surface M2 of the magnetic element 200 towards the system printed circuit board C1 and soldering the first electrode P1 to the eighth electrode P8 to the corresponding nodes R1 to R8 of the system printed circuit board C1 respectively. That is, by adjusting the area of the first soldering plane M1 and the second soldering plane M2 and disposing the first electrode P1 to the eighth electrode P8 properly, the footprint of the magnetic element 200 can remain the same as the magnetic element of prior art. Therefore, the magnetic element 200 can be coupled to the system printed circuit board, which is compatible with the magnetic element of prior art, without changing the footprint of the system printed circuit board.

Furthermore, an extension direction E1 of the first coiling body 212 is towards upward from (away from) the first soldering surface M1 of the first protruding portion 214. When the extension direction E1 is perpendicular to the first soldering surface M1 of the first protruding portion 214, wires on the first coiling body 212 can be coiled on the first coiling body 212 along the extension direction E1 and the first coiling body 212 can have a better utility rate. Similarly, an extension direction E2 of the second coiling body 222 is towards upward from (away from) the second soldering surface M2 of the fourth protruding portion 226. When the extension direction E2 is perpendicular to the second soldering surface M2 of the fourth protruding portion 226, wires on the second coiling body 222 can be coiled on the second coiling body 222 along the extension direction E2 and the second coiling body 222 can have a better utility rate.

In some embodiments of the present invention, a width X1 of the first protruding portion 214 and a width X2 of the second protruding portion 216 may exceed a width X3 of the first coiling body 212 so that the first magnetic core 210 can be a H-shaped magnetic core. Also, a width X4 of the third protruding portion 224 and a width X5 of the fourth protruding portion 226 may exceed a width X6 of the second coiling body 222 so that the second magnetic core 220 can be a H-shaped magnetic core.

In addition, the magnetic element 200 includes a first wire W1 to an eighth wire W8. The first wire W1 to the eighth wire W8 can be wires having outer insulation layers, for example, the first wire W1 to the eighth wire W8 can be enameled wires. The first wire W1 can be coiled on the first coiling body 212 and electrically coupled to the first electrode P1 and the fourth connection node Q4. The second wire W2 can be coiled on the first coiling body 212 and electrically coupled to the second electrode P2 and the third connection node Q3. The third wire W3 can be coiled on the first coiling body 212 and electrically coupled to the third electrode P3 and the second connection node Q2. The fourth wire W4 can be coiled on the first coiling body 212 and electrically coupled to the fourth electrode P4 and the first connection node Q1. The fifth wire W5 can be coiled on the second coiling body 222 and electrically coupled to the fifth connection node Q5 and the eighth electrode P8. The sixth wire W6 can be coiled on the second coiling body 222 and electrically coupled to the sixth connection node Q6 and the seventh electrode P7. The seventh wire W7 can be coiled on the second coiling body 222 and electrically coupled to the seventh connection node Q7 and the sixth electrode P6. The eighth wire W8 can be coiled on the second coiling body 222 and electrically coupled to the eighth connection node Q8 and the fifth electrode P5.

Figure 4:
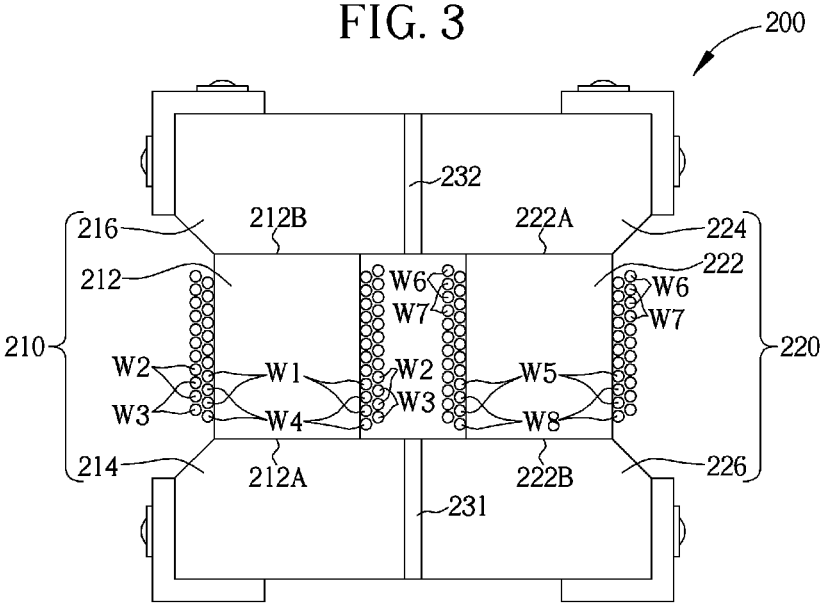
FIG. 4 shows a cross-section of the magnetic element in FIG. 2.

Furthermore, in the embodiment of FIGS. 2 and 3, because the second wire W2 and the third wire W3 are coiled along an outer side of the first wire W1 and the fourth wire W4 and the sixth wire W6 and the seventh wire W7 are coiled along the outer side of the fifth wire W5 and the eighth wire W8, only parts of the first wire W1, the fourth wire W4, the fifth wire W5 and the eighth wire W8 can be observed from outside of the first coiling body 212 and the second coiling body 222. FIG. 4 shows a cross section of the magnetic element 200. According to FIG. 4, the second wire W2 and the third wire W3 are coiled along the outer side of the first wire W1 and the fourth wire W4 and the sixth wire W6 and the seventh wire W7 are coiled along the outer side of the fifth wire W5 and the eighth wire W8.

In some embodiments of the present invention, the first connection node Q1 can be electrically coupled to the eighth connection node Q8, the second connection node Q2 can be electrically coupled to the seventh connection node Q7, the third connection node Q3 can be electrically coupled to the sixth connection node Q6, and the fourth connection node Q4 can be electrically coupled to the fifth connection node Q5. The aforementioned four pairs of connection nodes can be electrically coupled by wires, metal plate, electroplating, conductive paste (such as silver paste), or soldering.

In some embodiments of the present invention, the first electrode P1 can be a positive input terminal IN+ of the magnetic element 200, and the second electrode P2 can be a negative input terminal IN− of the magnetic element 200. In this case, the third electrode P3 can be electrically coupled to the fourth electrode P4, and the seventh electrode P7 can be electrically coupled to the eighth electrode P8 so that the fifth electrode P5 can be a negative output terminal OUT− of the magnetic element 200, and the sixth electrode P6 can be a positive output terminal OUT+ of the magnetic element 200.

In the embodiment of FIG. 3, the third electrode P3, the fourth electrode P4, the seventh electrode P7 and the eighth electrode P8 can be independent structures and not electrically coupled to others. The third electrode P3 and the fourth electrode P4 are electrically coupled together by the layout on the system printed circuit board C1 in FIG. 2 when soldering the magnetic element 200 to the system printed circuit board C1. Similarly, the seventh electrode P7 and the eighth electrode P8 are electrically coupled together by the layout on the system printed circuit board C1. Therefore, before the magnetic element 200 is soldered to the system printed circuit board C1, the equivalent circuit of the magnetic element 200 can be seen as four independent wires, that is, the first wire W1 and the fifth wire W5 forming one independent wire, the second wire W2 and the sixth wire W6 forming one independent wire, the third wire W3 and the seventh wire W7 forming one independent wire, and the fourth wire W4 and the eighth wire W8 forming one independent wire. In the system printed circuit board C1 in FIG. 2, the node R3 can be electrically coupled to the node R4 by conductive trace, wire, metal plate, electroplating, conductive paste (ex., silver paste) or soldering, and the node R7 can also be electrically coupled to the node R8 by conductive trace, wire, metal plate, electroplating, conductive paste (ex., silver paste) or soldering so that the third electrode P3 can be electrically coupled to the fourth electrode P4 through the connecting circuit on the system printed circuit board C1 and the seventh electrode P7 can be electrically coupled to the eighth electrode P8 through the connecting circuit on the system printed circuit board C1 when soldering the magnetic element 200 to the system printed circuit board C1, making the magnetic element 200 become a transformer.

However, the electrodes may also be coupled together without the system printed circuit board. In some embodiments of the present invention, the third electrode P3 and the fourth electrode P4 can also be electrically coupled together directly by wire, metal plate, electroplating, conductive paste (ex., silver paste) or soldering, and the seventh electrode P7 and the eighth electrode P8 can also be electrically coupled together directly by wire, metal plate, electroplating, conductive paste (ex., silver paste) or soldering. In this case, the nodes R3 and R4 in the system printed circuit board can be independent from each other without electrically coupling to each other, and the nodes R7 and R8 can also be independent from each other without electrically coupling to each other.

Furthermore, in some embodiments of the present invention, the first electrode P1 may be a negative input terminal IN− of the magnetic element 200, the second electrode P2 may be a positive input terminal IN+ of the magnetic element 200, the fifth electrode P5 may be a positive output terminal OUT+ of the magnetic element 200, and sixth electrode P6 may be a negative output terminal OUT− of the magnetic element 200.

Figure 5:
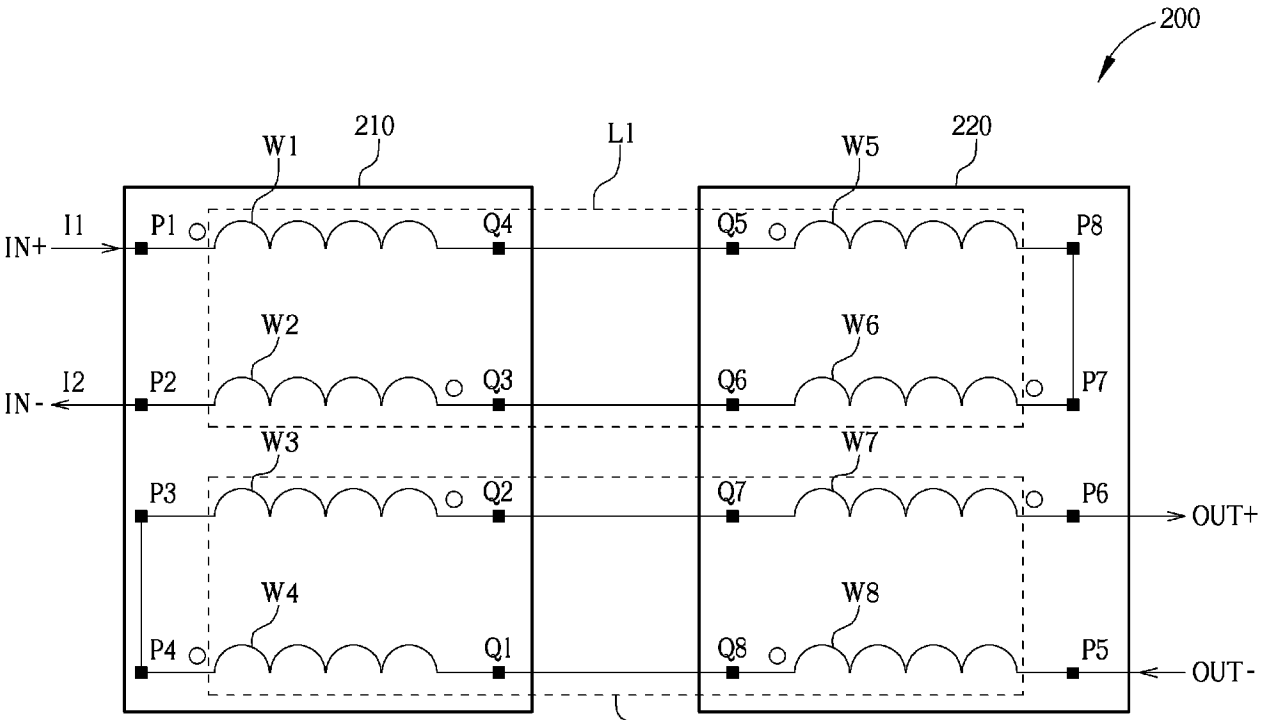
FIG. 5 shows an equivalent circuit of the magnetic element in FIG. 2.

FIG. 5 shows an equivalent circuit of the magnetic element 200. In FIG. 5, the first electrode P1 is the positive input terminal IN+ the magnetic element 200 and the second electrode P2 is the negative input terminal IN− of the magnetic element 200. According to FIG. 5, the first wire W1, the fifth wire W5, the sixth wire W6 and the second wire W2 can be electrically coupled in series to form an equivalent inductor L1, and the third wire W3, the seventh wire W7, the eighth wire W8 and the fourth wire W4 can be electrically coupled in series to form another equivalent inductor L2.

In other words, the magnetic element 200 may receive an input current I1 from the first electrode P1 and the second electrode P2, and the input current I1 can flow through the first wire W1, the fifth wire W5, the sixth wire W6, and the second wire W2 sequentially. The input current I1 flowing through the first wire W1, the fifth wire W5, the sixth wire W6, and the second wire W2 can generate a first magnetic field. The strength of the first magnetic field will vary with the strength of the current, which induces an induced current I2 flowing through the third wire W3, the seventh wire W7, the eighth wire W8, and the fourth wire W4 to generate a second magnetic field resisting the first magnetic field. That is, a magnetic flux of the first magnetic field is pointing to an opposite direction of a magnetic flux of the second magnetic field. The magnetic element 200 can adjust the induced voltage generated by the induced current I2 by selecting proper turns ratios among the number of coils of the first wire W1 to the eighth wire W8, and use the induced voltage as the output voltage to achieve the function of a transformer.

For example, when using the magnetic element 200 as a transformer applied in the Ethernet, the total coil number of the primary winding of the magnetic element 200 can be equal to the total coil number of the secondary winding of the magnetic element 200. That is, the turns ratio of coil numbers is equal to 1. The primary winding comprises the first wire W1, the fifth wire W5, the sixth wire W6, and the second wire W2, and the secondary winding comprises the third wire W3, the seventh wire W7, the eighth wire W8 and the fourth wire W4.

Figure 6:
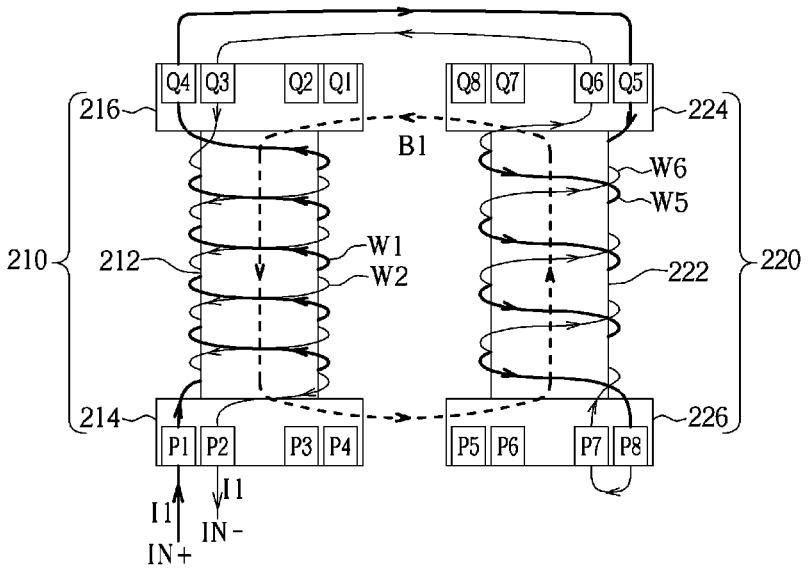
FIG. 6 shows parts of the magnetic element in FIG. 2.

FIG. 6 shows parts of the magnetic element 200. FIG. 6 shows the relations among the first wire W1, the second wire W2, the fifth wire W5, the sixth wire W6, the electrodes and connection nodes. In FIG. 6, the input current I1 flows through the first electrode P1, the first wire W1, the fourth connection node Q4, the fifth connection node Q5, the fifth wire W5, the eighth electrode P8, the seventh electrode P7, the sixth wire W6, the sixth connection node Q6, the third connection node Q3, the second wire W2, and the second electrode P2 sequentially. The first wire W1 and the fifth wire W5 can be coiled on the first coiling body 212 and the second coiling body 222 respectively along a same first coiling direction and the second wire W2 and the sixth wire W6 can be coiled on the first coiling body 212 and the second coiling body 222 respectively along a same second coiling direction opposite to the first coiling direction so that the magnetic flux of the magnetic field generated by the input current I1 flowing through the first wire W1, the fifth wire W5, the sixth wire W6 and the second wire W2 can be coherent. Consequently, the magnetic flux of the magnetic field generated by the input current I1 flowing through the first wire W1, the fifth wire W5, the sixth wire W6 and the second wire W2 can pass through the first coiling body 212 and the second coiling body 222 counterclockwise and form a first magnetic field B1.

Figure 7:
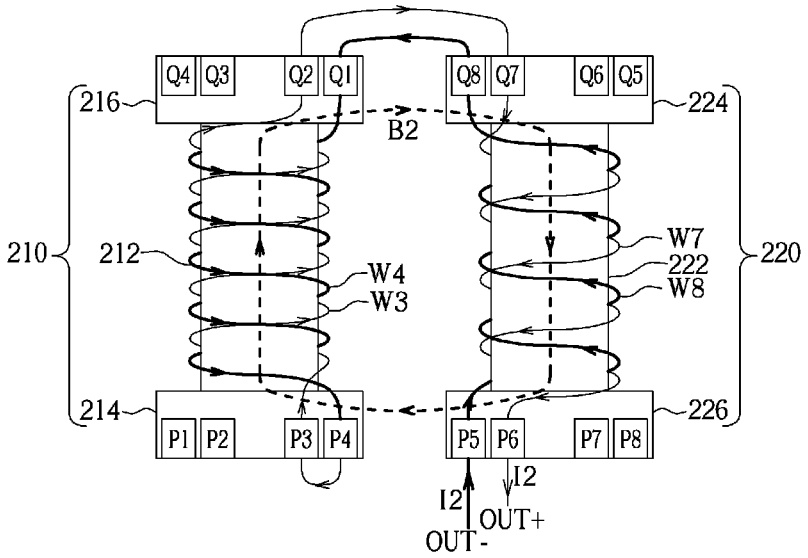
FIG. 7 shows other parts of the magnetic element in FIG. 2.

FIG. 7 shows parts of the magnetic element 200. FIG. 7 shows the relations among the third wire W3, the fourth wire W4, the seventh wire W7, the eighth wire W8, the electrodes and connection nodes. In FIG. 7, the induced current I2 flows through the fifth electrode P5, the eighth wire W8, the eighth connection node Q8, the first connection node Q1, the fourth wire W4, the fourth electrode P4, the third electrode P3, the third wire W3, the second connection node Q2, the seventh connection node Q7, the seventh wire W7, and the sixth electrode P6 sequentially. The fourth wire W4 and the eighth wire W8 can be coiled on the first coiling body 212 and the second coiling body 222 respectively along the same first coiling direction and the third wire W3 and the seventh wire W7 can be coiled on the first coiling body 212 and the second coiling body 222 respectively along the same second coiling direction opposite to the first coiling direction so that the magnetic flux of the magnetic field generated by the induced current I2 flowing through the third wire W3, the fourth wire W4, the seventh wire W7 and the eighth wire W8 can be coherent and with an opposite direction to the magnetic flux of the magnetic field generated by the input current I1. Consequently, the magnetic flux of the magnetic field generated by the induced current I2 flowing through the third wire W3, the fourth wire W4, the seventh wire W7 and the eighth wire W8 can pass through the first coiling body 212 and the second coiling body 222 clockwise and form a second magnetic field B2.

In other words, the first wire W1 and the fourth wire W4 can be coiled on the first coiling body 212 along the first coiling direction, and the second wire W2 and the third wire W3 can be coiled on the first coiling body 212 along the second coiling direction opposite to the first coiling direction. The fifth wire W5 and the eighth wire W8 can be coiled on the second coiling body 222 along the first coiling direction, and the sixth wire W6 and the seventh wire W7 can be coiled on the second coiling body 222 along the second coiling direction.

In FIGS. 4 and 5, if observed along a direction from the second protruding portion 216 to the first protruding portion 214 (or from the third protruding portion 224 to the fourth protruding portion 226), then the first coiling direction is counterclockwise along the first coiling body 212 (or the second coiling body 222) and the second coiling direction is clockwise along the first coiling body 212 (or the second coiling body 222). However, in some embodiments of the present invention, when observed from the second protruding portion 216 to the first protruding portion 214 (or from the third protruding portion 224 to the fourth protruding portion 226), the first coiling direction can also be defined as clockwise along the first coiling body 212 (or the second coiling body 222) and the second coiling direction can be defined as counterclockwise along the first coiling body 212 (or the second coiling body 222). In this case, the directions of the first magnetic field B1 and the second magnetic field B2 would also alter.

Figure 8:
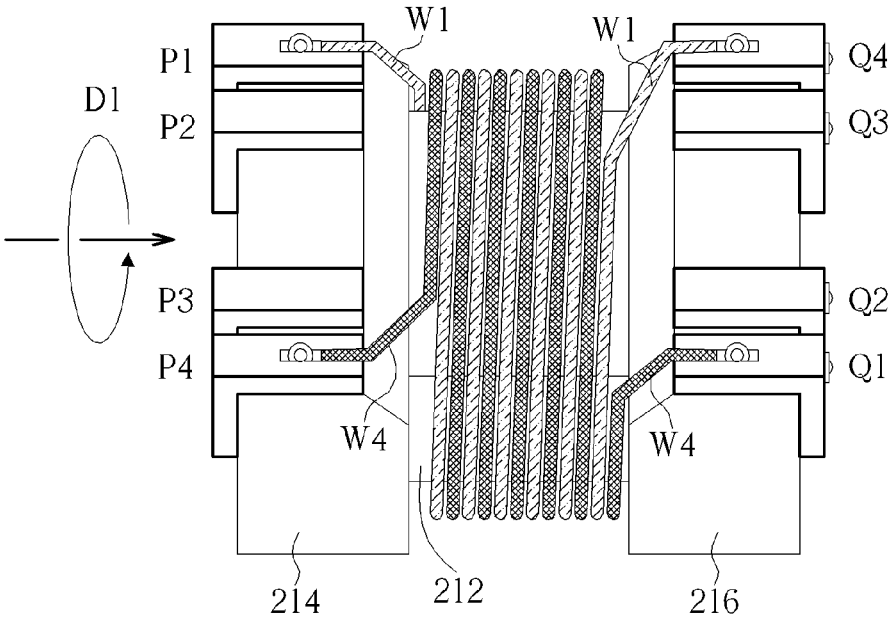
FIG. 8 shows parts of processes of producing the magnetic element in FIG. 2.
Figure 9:
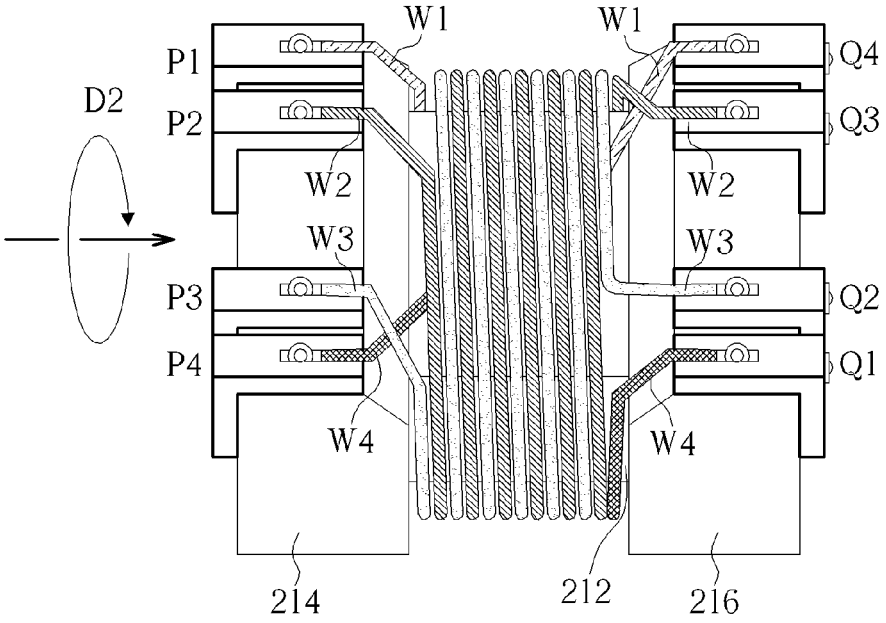
FIG. 9 shows other parts of processes of producing the magnetic element in FIG. 2.

In addition, FIGS. 8 and 9 show processes of producing the magnetic element 200 according to one embodiment of the present invention. The first wire W1 and the fourth wire W4 can be coiled on the first coiling body 212 according to a same coiling direction while the second wire W2 and the third wire W3 can be coiled on the first coiling body 212 according to another same coiling direction in practical. Therefore, in FIGS. 8 and 9, to simplify the processes of producing the magnetic element 200, after electrically coupling a terminal of the first wire W1 to the first electrode P1 and electrically coupling a terminal of the fourth wire W4 to the fourth electrode P4 by using laser, thermal compression bonding or soldering, the first coiling body 212 is spun with respect to a first spinning direction D1 so that first wire W1 and the fourth wire W4 can be coiled interleaving on the first coiling body 212 along the first coiling direction. After coiled, another terminal of the first wire W1 can be electrically coupled to the fourth connection node Q4 and another terminal of the fourth wire W4 can be electrically coupled to the first connection node Q1.

Next, in FIG. 9, after electrically coupling a terminal of the second wire W2 to the second electrode P2 and electrically coupling a terminal of the third wire W3 to the third electrode P3, the first coiling body 212 can be spun with respect to a second spinning direction D2 opposite to the first spinning direction D1 so that second wire W2 and the third wire W3 can be coiled interleaving on the first coiling body 212 along the second coiling direction. After coiled, another terminal of the second wire W2 can be electrically coupled to the third connection node Q3 and another terminal of the third wire W3 can be electrically coupled to the second connection node Q2. Namely, the first wire W1 and the fourth wire W4 are coiled on the first coiling body 212 interleaving while the second wire W2 and the third wire W3 are also coiled on the first coiling body 212 and are coiled along an outer side of the first wire W1 and the fourth wire W4. Similarly, the fifth wire W5 to the eighth wire W8 can also be coiled on the second coiling body 222 according to the similar processes shown in FIGS. 8 and 9.

Consequently, the second wire W2 and the third wire W3 can be coiled along the outer side of the first wire W1 and the fourth wire W4 while the sixth wire W6 and the seventh wire W7 can be coiled along the outer side of the fifth wire W5 and the eighth wire W8 as the magnetic element 200 shown in FIG. 4. However, the second wire W2 and the third W3 may not necessarily be coiled along the outer side of the first wire W1 and the fourth wire W4. In some embodiments of the present invention, the second wire W2 and the third W3 can be coiled interleaving on the first coiling body along the second coiling direction firstly, and then the first wire W1 and the fourth wire W4 can be coiled interleaving along the first coiling direction along the outer side of the second wire W2 and the third wire W3. That is, the processes shown in FIG. 9 can be executed firstly before the processes shown in FIG. 8. In this case, the first wire W1 and the fourth wire W4 are coiled interleaving while the second wire W2 and the third wire W3 are also coiled interleaving, and first wire W1 and the fourth wire W4 are coiled along the outer side of the second wire W2 and the third wire W3. Similarly, the fifth wire W5 and the eighth wire W8 can also be coiled along the outer side of the sixth wire W6 and the seventh wire W7.

Since the first protruding portion 214 and the second protruding portion 216 of the first magnetic core 210 can be connected to the fourth protruding portion 226 and the third protruding portion 224 of the second magnetic core 220 respectively by the adhesive 231 and 232 in the magnetic element 200, the first magnetic core 210 and the second magnetic core 220 can be towards away from the system printed circuit board while the wires can be coiled on the first magnetic core 210 and the second magnetic core 220. Therefore, wires with greater diameter, such as wires with diameter over 90 μm, can be used to avoid the magnetic core from reaching high temperature while the self-inductance of the magnetic element can be preserved without changing the plane area and the footprint of the element. Thus, the issue that the outer insulation layer of the wires are softened, which may cause the magnetic element to be short circuited or lacking of voltage endurance, due to the high temperature of the wires can be solved.

Furthermore, wires with greater diameter can also help to reduce the copper loss and the high frequency transmission loss. When the magnetic element of the present invention is used as a transformer for the Ethernet application compatible with Power Over Ethernet (POE), the magnetic element can keep the copper loss and the high frequency transmission loss to lower levels even being operated with high currents, ex., currents over 200 mA.

Figure 10:
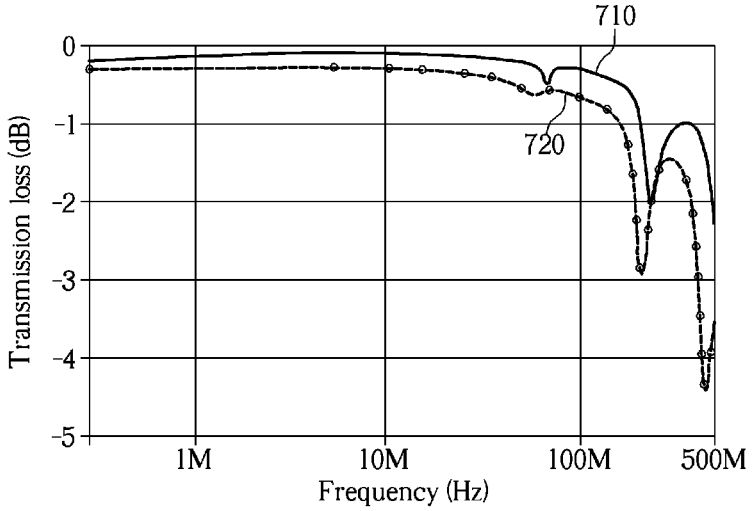
FIG. 10 shows a relation between transmission loss and frequency of a magnetic element of prior art and a relation between transmission loss and frequency of the magnetic element in FIG. 2.

FIG. 10 shows a curve representing the relation between transmission loss (SDD21) (or input differential insertion loss) and frequency of a magnetic element of prior art and the relation between transmission loss and frequency of the magnetic element 200. The vertical axis represents the input differential insertion loss of the magnetic element measured by decibel (dB). The closer the value of the vertical coordinate is to 0, the lower the input differential insertion loss is. The horizontal axis represents the frequency measured by Hertz (Hz). The curve 710 represents the frequency response of the magnetic element 200, and the current 720 represents the frequency response of the magnetic element of prior art. According to FIG. 10, the transmission loss of the magnetic element 200 is significantly smaller than the transmission loss of the magnetic element of prior art.

Figure 11:
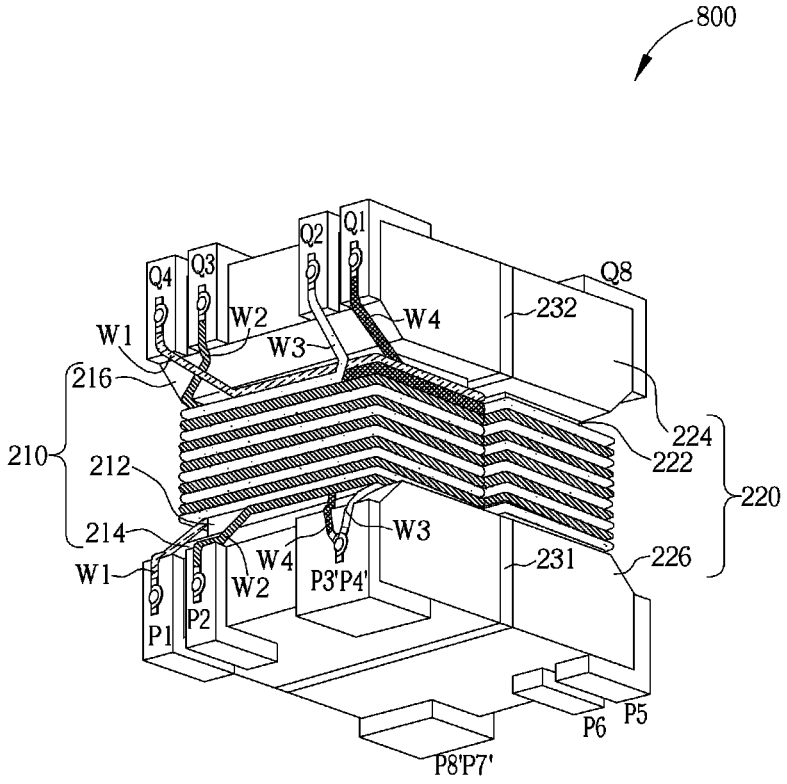
FIG. 11 shows a magnetic element according to another embodiment of the present invention.

In addition, since the third electrode P3 and the fourth electrode P4 are electrically coupled together and the seventh electrode P7 and the eighth electrode P8 are electrically coupled together, the third electrode P3 and the fourth electrode P4 can be directly electrically coupled together and the seventh electrode P7 and the eighth electrode P8 can be directly electrically coupled together without using external wires. FIG. 11 shows a magnetic element 800 according to one embodiment of the present invention. The difference between the magnetic elements 800 and 200 is in that the third electrode P3' and the fourth electrode P4' are disposed on a same L-shaped lead frame to be directly coupled together. That is, the third wire W3 and the fourth wire W4 can be soldered to the same and wider L-shaped lead frame without using external wires for connection. Also, the seventh electrode P7' and the eighth electrode P8' can be disposed on a same L-shaped lead frame to be directly coupled together. That is, the fifth wire W5 and the sixth wire W6 can be soldered to the same and wider L-shaped lead frame without using external wires for connection.

In FIG. 2, the third wire W3 and the fourth wire W4 are crossing each other near the third electrode P3 and the fourth electrode P4, and the first wire W1 and the second wire W2 are crossing each other near the third connection node Q3 and the fourth connection node Q4. Since tension of wires can increase during a coiling process, the wires can be worn down and short circuited if the wires are crossing each other near electrodes or connection nodes during the coiling process. In addition, after terminals of the wires are coupled to the electrodes or the connection nodes by laser, thermal compression bonding or soldering, insulation layers of part of the wires extending from the electrodes or the connection nodes may be removed, which makes the wire easily worn down and short circuited even more easily. Therefore, in some embodiments of the present invention, the relative positions among all the nodes (including the electrodes and the connection nodes) can be adjusted to keep the wire-crossing region away from the electrodes or the connection nodes. However, to ensure the magnetic element 200 can be connected to other elements on the circuit board easily, when changing the relative positions the nodes (including the electrodes and the connection nodes), the first electrode P1 may still be disposed adjacent to the second electrode P2, the third electrode P3 may be disposed adjacent to the fourth electrode P4, the fifth electrode P5 may be disposed adjacent to the sixth electrode P6, and the seventh electrode P7 may be disposed adjacent to the eighth electrode P8. In this case, the positive input terminal would be disposed adjacent to the negative input terminal, and the positive output terminal would be disposed adjacent to the negative output terminal.

Figure 12:
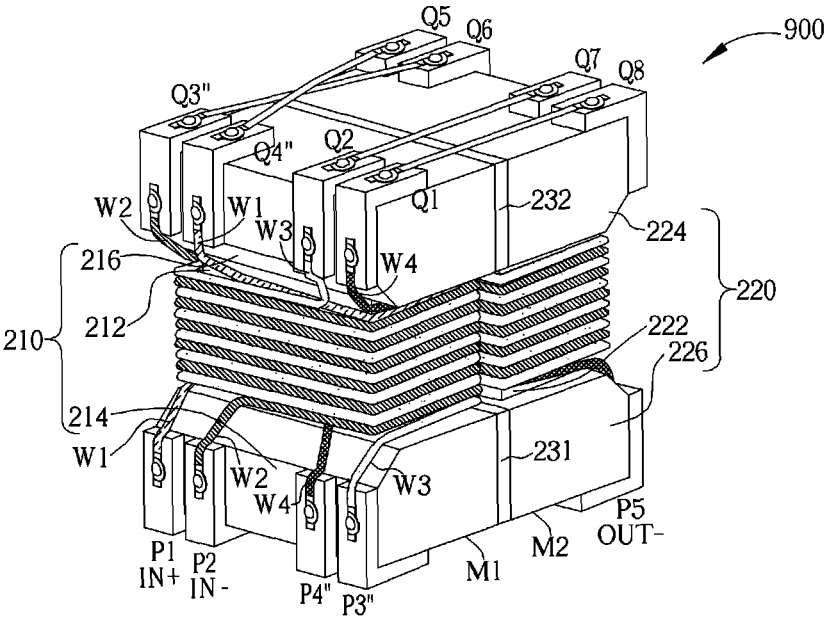
FIG. 12 shows a magnetic element from a first view according to another embodiment of the present invention.
Figure 13:
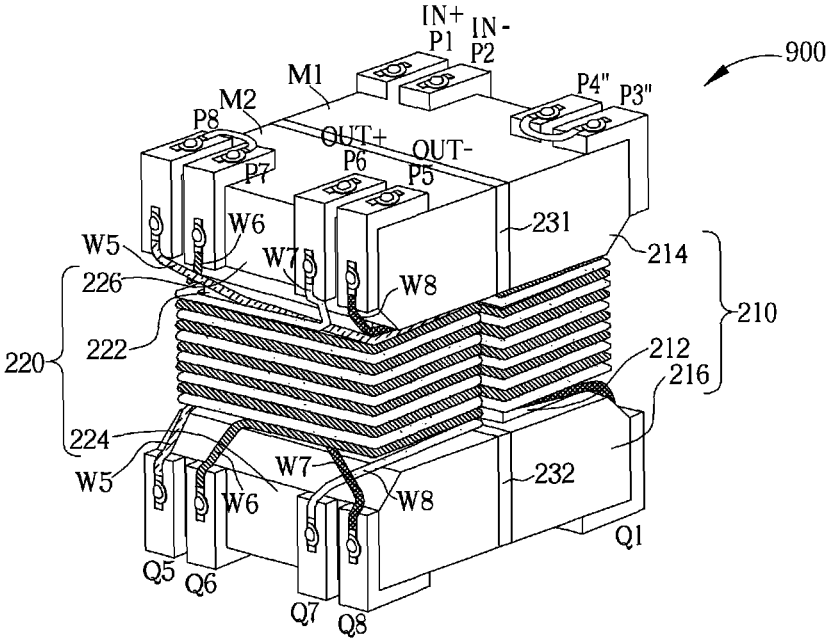
FIG. 13 shows the magnetic element in FIG. 12 from a second view.

FIG. 12 shows a magnetic element 900 from a first view according to one embodiment of the present invention, and FIG. 13 shows the magnetic element 900 from a second view. The magnetic element 900 has similar operation principles as the magnetic element 200. The difference between these two is in that the relative position between the third electrode P3" and the fourth electrode P4" of the magnetic element 900 is different from the relative position between the third electrode P3 and the fourth electrode P4 of the magnetic element 200. That is the position of the third electrode P3 and the position of the fourth electrode P4 of the magnetic element 200 are switched in the magnetic element 900. Also, the relative position between the third connection node Q3" and the fourth connection node Q4" of the magnetic element 900 is different from the relative position between the third connection node Q3 and the fourth connection node Q4 of the magnetic element 200. That is the position of the third connection node Q3 and the fourth connection node Q4 of the magnetic element 200 are switched in the magnetic element 900.

Consequently, on the first magnetic core 210 of the magnetic element 900, the wire-crossing region is further away from the electrodes or the connection nodes. Although the wires between the third connection nodes Q3" and the sixth connection node Q6 may cross with the wires between the fourth connection node Q4" and the fifth connection node Q5, the tensions of the wires are smaller because the wires between the third connection nodes Q3" and the sixth connection node Q6 and the wires between the fourth connection node Q4" and the fifth connection node Q5 are not coiled by spinning the coiling bodies and are further away from the connection nodes. In addition, the insulation layers of the wires can be preserved, which can further reduce the risk that the wires are worn down and short circuited.

Figure 14:
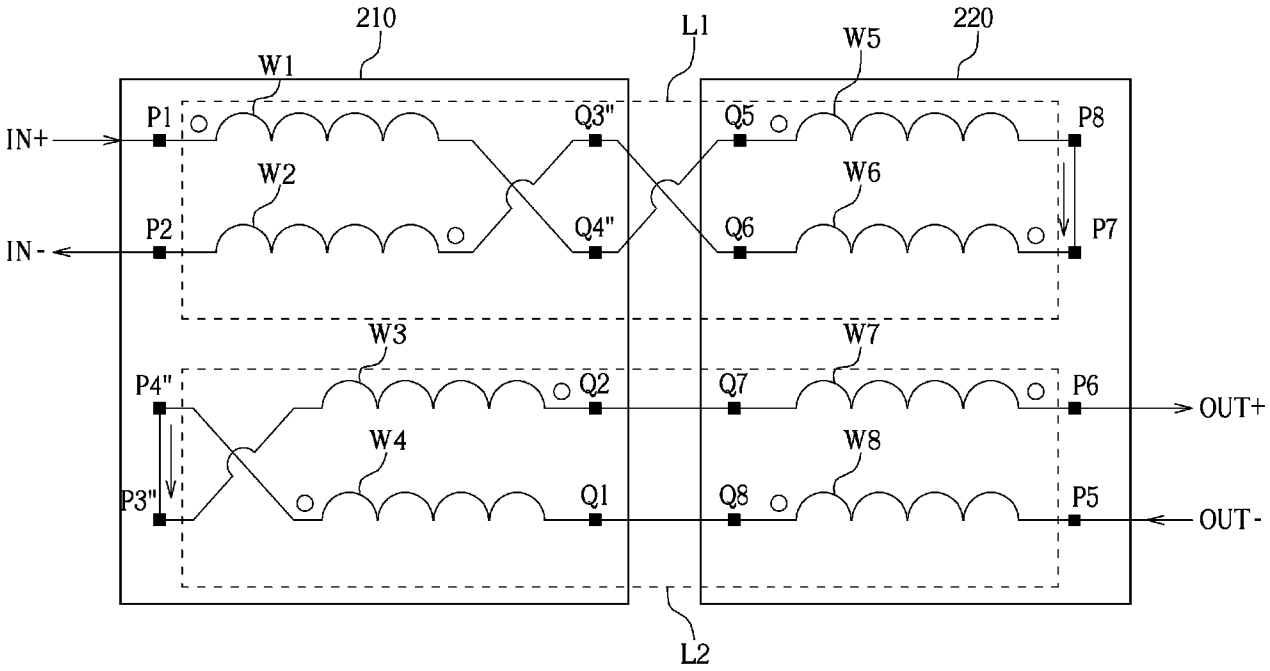
FIG. 14 shows an equivalent circuit of the magnetic element in FIG. 12.

FIG. 14 shows an equivalent circuit of the magnetic element 900. According to FIG. 14, the first wire W1, the fifth wire W5, the sixth wire W6 and the second wire W2 are still electrically coupled in series to form the equivalent inductor L1 and the third wire W3, the seventh wire W7, the eighth wire W8 and the fourth wire W4 are also electrically coupled in series to form the equivalent inductor L2 even though the positions of parts of the electrodes and connection nodes in the magnetic element 900 are different from those in the magnetic element 200.

In FIGS. 3 and 13, the seventh wire W7 and the eighth wire W8 are crossing each other near the seventh connection node Q7 and the eighth connection node Q8, and the fifth wire W5 and the sixth wire W6 are crossing each other near the seventh electrode P7 and the eighth electrode P8. Therefore, the relative positions of the seventh connection node Q7 and the eighth connection node Q8 can be switched and the relative positions of the seventh electrode P7 and the eighth electrode P8 can be switched so that the wires can be protected from being worn down and short circuited when coiled on the magnetic cores.

Figure 15:
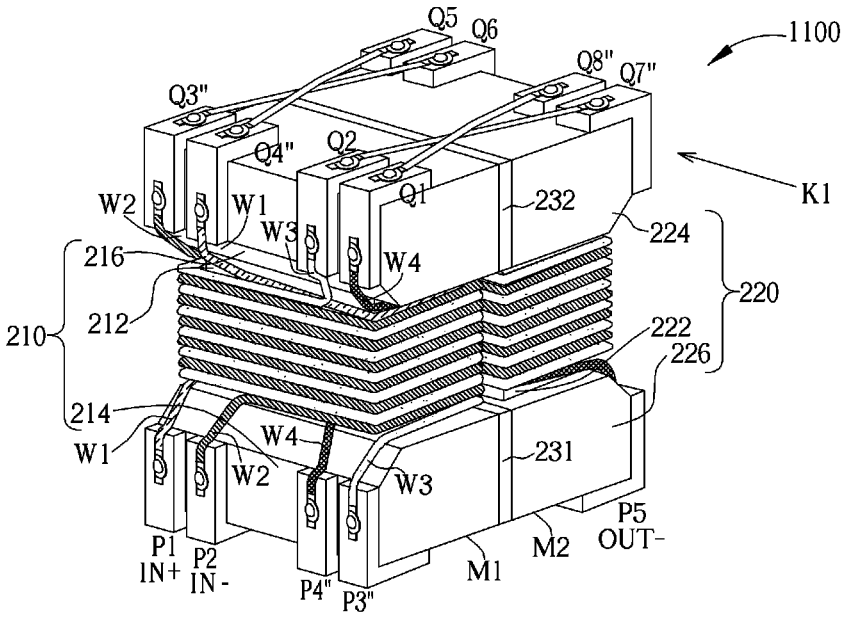
FIG. 15 shows a magnetic element from a first view according to another embodiment of the present invention.
Figure 16:
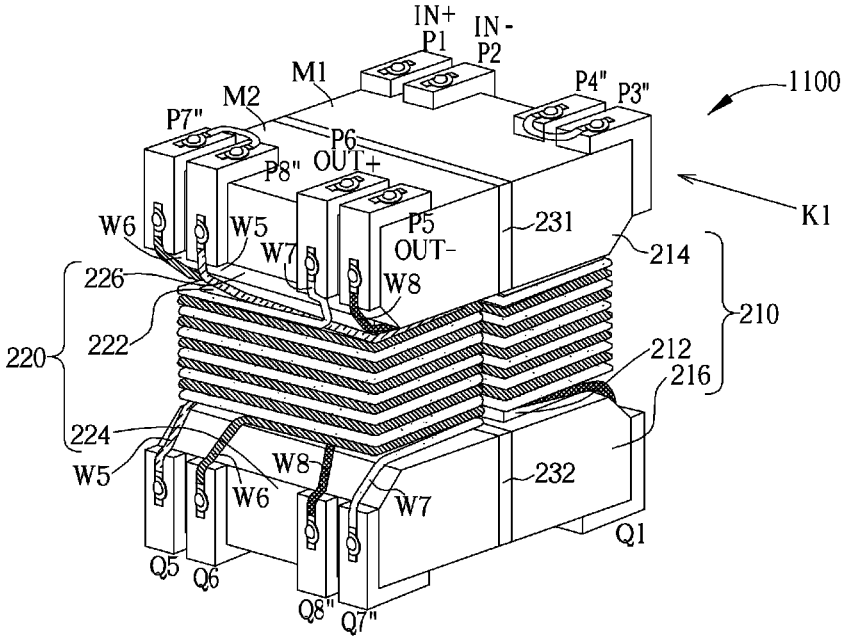
FIG. 16 shows the magnetic element in FIG. 15 from a second view.

FIG. 15 shows a magnetic element 1100 from a first view according to one embodiment of the present invention, and FIG. 16 shows the magnetic element 1100 from a second view. The magnetic element 1100 has similar operation principles as the magnetic element 900. The difference between these two is in that the relative position between the seventh connection node Q7" and the eighth connection node Q8" of the magnetic element 900 is different from the relative position between the seventh connection node Q7 and the eighth connection node Q8 of the magnetic element 900. That is the position of the seventh connection node Q7 and the eighth connection node Q8 of the magnetic element 900 are switched in the magnetic element 1100. Also, the relative position between the seventh electrode P7" and the eighth electrode P8" of the magnetic element 1100 is different from the relative position between the seventh electrode P7 and the eighth electrode P8 of the magnetic element 900. That is the position of the seventh electrode P7 and the eighth electrode P8 of the magnetic element 900 are switched in the magnetic element 1100. Consequently, all the wire-crossing regions can be away from the electrodes and the connection nodes.

In other words, when observing the first protruding portion 214 and the second protruding portion 216 from the first view in FIG. 15, the third electrode P3", the fourth electrode P4", the second electrode P2 and the first electrode P1 are arranged sequentially on the first protruding portion 214 along a disposing direction K1 in parallel to the first soldering surface M1. The first connection node Q1, the second connection node Q2, the fourth connection node Q4" and the third connection node Q3" are arranged sequentially on the second protruding portion 216 along the disposing direction K1. When observing the third protruding portion 224 from the first view in FIG. 15, the seventh connection node Q7", the eighth connection node Q8", the sixth connection node Q6 and the fifth connection node Q5 are arranged sequentially on the third protruding portion 224 along the disposing direction K1 parallel to the second soldering surface M2. When observing the second soldering surface M2 of the fourth protruding portion 226 from the second view in FIG. 16, the fifth electrode P5, the sixth electrode P6, the eighth electrode P8" and the seventh electrode P7" are arranged sequentially on the fourth protruding portion 226 along the disposing direction K1. The disposing direction K1 is extending from a side of a protruding portion of the protruding portions 214, 216, 224, and 226 to another side of the protruding portion.

Figure 17:
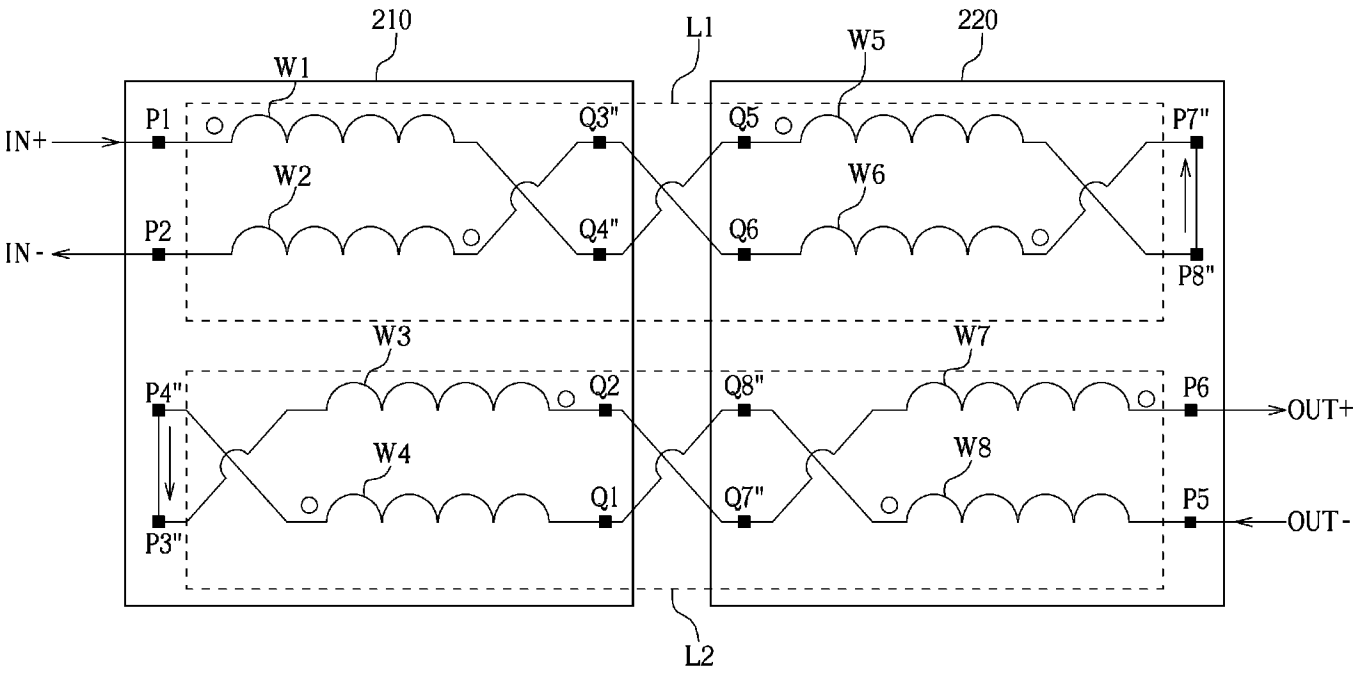
FIG. 17 shows an equivalent circuit of the magnetic element in FIG. 15.

FIG. 17 shows an equivalent circuit of the magnetic element 1100. According to FIG. 17, the first wire W1, the fifth wire W5, the sixth wire W6 and the second wire W2 are still electrically coupled in series to form the equivalent inductor L1 and the third wire W3, the seventh wire W7, the eighth wire W8 and the fourth wire W4 are also electrically coupled in series to form the equivalent inductor L2 even though the positions of parts of the electrodes and connection nodes in the magnetic element 1100 are different from those in the magnetic element 200.

Figure 18:
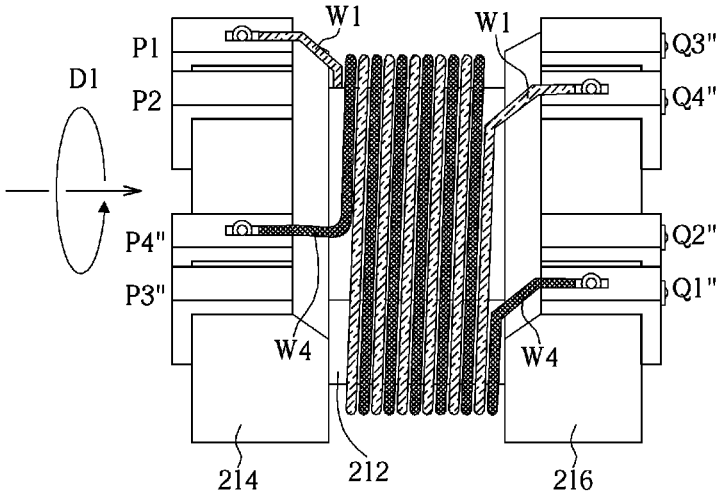
FIG. 18 shows parts of processes of producing the magnetic element in FIG. 15.
Figure 19:
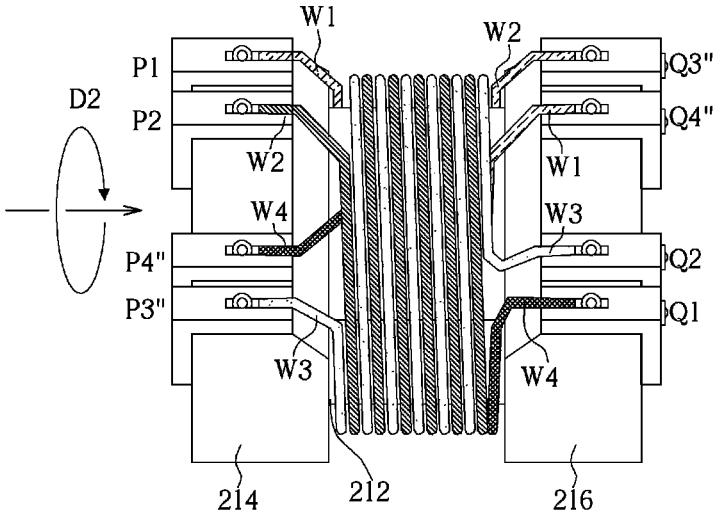
FIG. 19 shows other parts of processes of producing the magnetic element in FIG. 15.

FIGS. 18 and 19 show processes of producing the magnetic element 1100 according to one embodiment of the present invention. The processes shown in FIGS. 18 and 19 are similar to the processes shown in FIGS. 8 and 9. In FIG. 18, after electrically coupling a terminal of the first wire W1 to the first electrode P1 and electrically coupling a terminal of the fourth wire W4 to the fourth electrode P4" by using laser, thermal compression bonding or soldering, the first coiling body 212 is spun with respect to a first spinning direction D1 so that first wire W1 and the fourth wire W4 can be coiled interleaving on the first coiling body 212 along the first coiling direction. After coiled, another terminal of the first wire W1 can be electrically coupled to the fourth connection node Q4" and another terminal of the fourth wire W4 can be electrically coupled to the first connection node Q1.

Next, in FIG. 19, after electrically coupling a terminal of the second wire W2 to the second electrode P2 and electrically coupling a terminal of the third wire W3 to the third electrode P3", the first coiling body 212 can be spun with respect to a second spinning direction D2 opposite to the first spinning direction D1 so that second wire W2 and the third wire W3 can be coiled interleaving on the first coiling body 212 along the second coiling direction. After coiled, another terminal of the second wire W2 can be electrically coupled to the third connection node Q3" and another terminal of the third wire W3 can be electrically coupled to the second connection node Q2. Namely, in FIG. 19, the second wire W2 and the third wire W3 are coiled along an outer side of the first wire W1 and the fourth wire W4. Similarly, the fifth wire W5 to the eighth wire W8 can also be coiled on the second coiling body 222 according to the similar processes shown in FIGS. 18 and 19. Since the relative positions of the electrodes and the connection nodes in magnetic element 1100 have been adjusted properly, the wire-crossing region can be away from the electrodes and the connection nodes, which can protect the wires from being worn down and short circuited.

Since the magnetic cores in the magnetic elements 900 and 1100 can be towards away from the system printed circuit board while the wires can be coiled on the magnetic cores, wires with greater diameter can be used to avoid the magnetic core from reaching high temperature while the self-inductance of the magnetic element can be preserved without changing the plane area and the footprint of the element. Furthermore, wires with greater diameter can also help to reduce the copper loss and the high frequency transmission loss. Therefore, the magnetic element of the present invention can be used on products with current loading over 200 mA, such as Ethernet applications compatible with Power Over Ethernet (POE).

Figure 20:
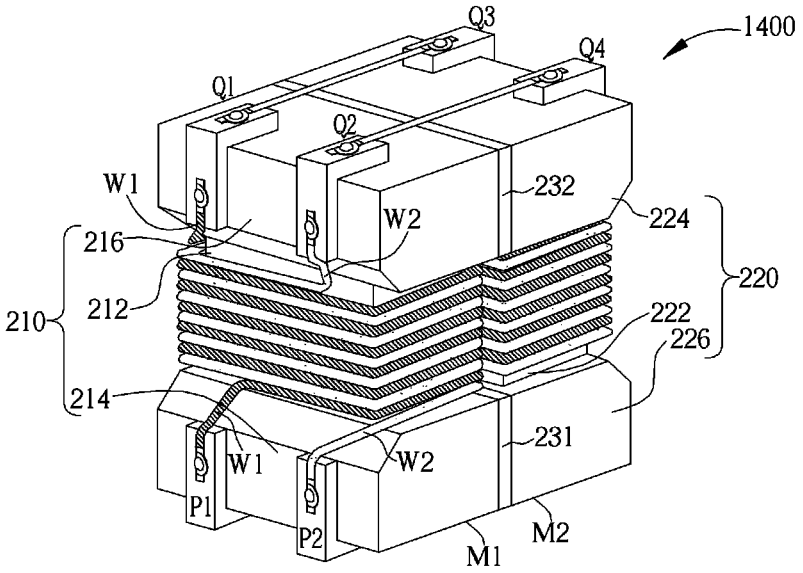
FIG. 20 shows a magnetic element from a first view according to another embodiment of the present invention.
Figure 21:
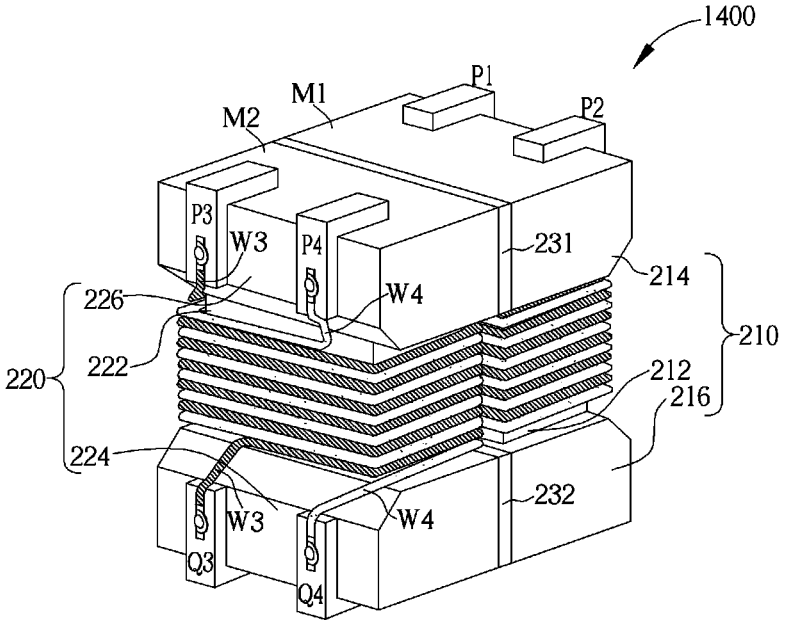
FIG. 21 shows the magnetic element in FIG. 20 from a second view.

In addition, the magnetic element of the present invention is not limited to be applied on transformers. In some embodiments of the present invention, the magnetic element can also be used as an inductor or a common mode choke. FIG. 20 shows a magnetic element 1400 from a first view according to one embodiment of the present invention, and FIG. 21 shows the magnetic element 1400 from a second view. The magnetic element 1400 includes the first electrode P1 to the fourth electrode P4, the first connection node Q1 to the fourth connection node Q4, and the first wire W1 to the fourth wire W4. The first electrode P1 and the second electrode P2 are disposed on the first soldering surface M1 of the first protruding portion 214, and the first connection node Q1 and the second connection node Q2 are disposed on the second protruding portion 216. The third connection node Q3 and the fourth connection node Q4 are disposed on the third protruding portion 224, and the third electrode P3 and the fourth electrode P4 are disposed on the second soldering surface M2 of the fourth protruding portion 226.

The first wire W1 can be coiled on the first coiling body 212 and electrically coupled to the first electrode P1 and the first connection node Q1. The second wire W2 can be coiled on the first coiling body 212 and electrically coupled to the second electrode P2 and the second connection node Q2. The third wire W3 can be coiled on the second coiling body 222 and electrically coupled to the third connection node Q3 and the third electrode P3. The fourth wire W4 can be coiled on the second coiling body 222 and electrically coupled to the fourth connection node Q4 and the fourth electrode P4. Furthermore, the first connection node Q1 is electrically coupled to the third connection node Q3, and the second connection node Q2 is electrically coupled to the fourth connection node Q4.

Figure 22:
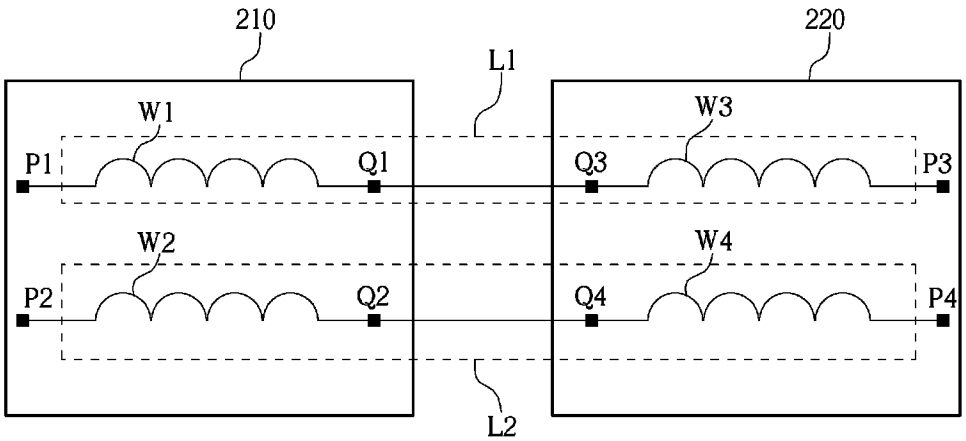
FIG. 22 shows an equivalent circuit of the magnetic element in FIG. 20.

FIG. 22 shows an equivalent circuit of the magnetic element 1400. According to FIG. 22, the first wire W1 and the third wire W3 of the magnetic element 1400 can be coupled in series through the first connection node Q1 and the third connection node Q3 to form the equivalent inductor L1, and the second wire W2 and the fourth wire W4 can be coupled in series through the second connection node Q2 and the fourth connection node Q4 to form the equivalent inductor L2. The equivalent inductor L1 and the equivalent inductor L2 can form a common mode choke, and can be used to filter the common mode electromagnetic interference from the internal signal traces or to restrain the electromagnetic interference generated by system to external elements.

Figure 23:
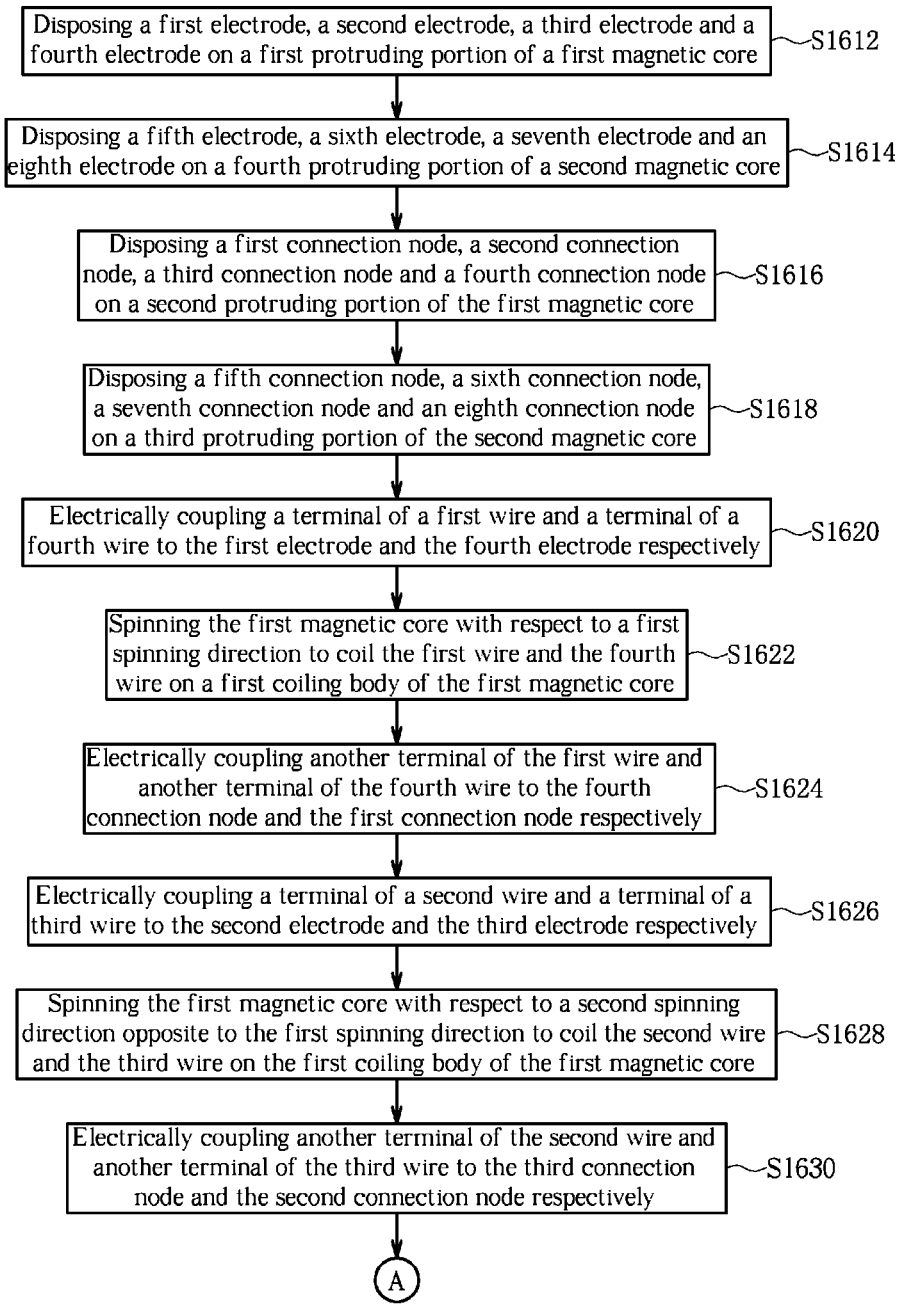
FIGS. 23 and 24 show a flow chart of a method for producing a magnetic element according to one embodiment of the present invention.
Figure 24:
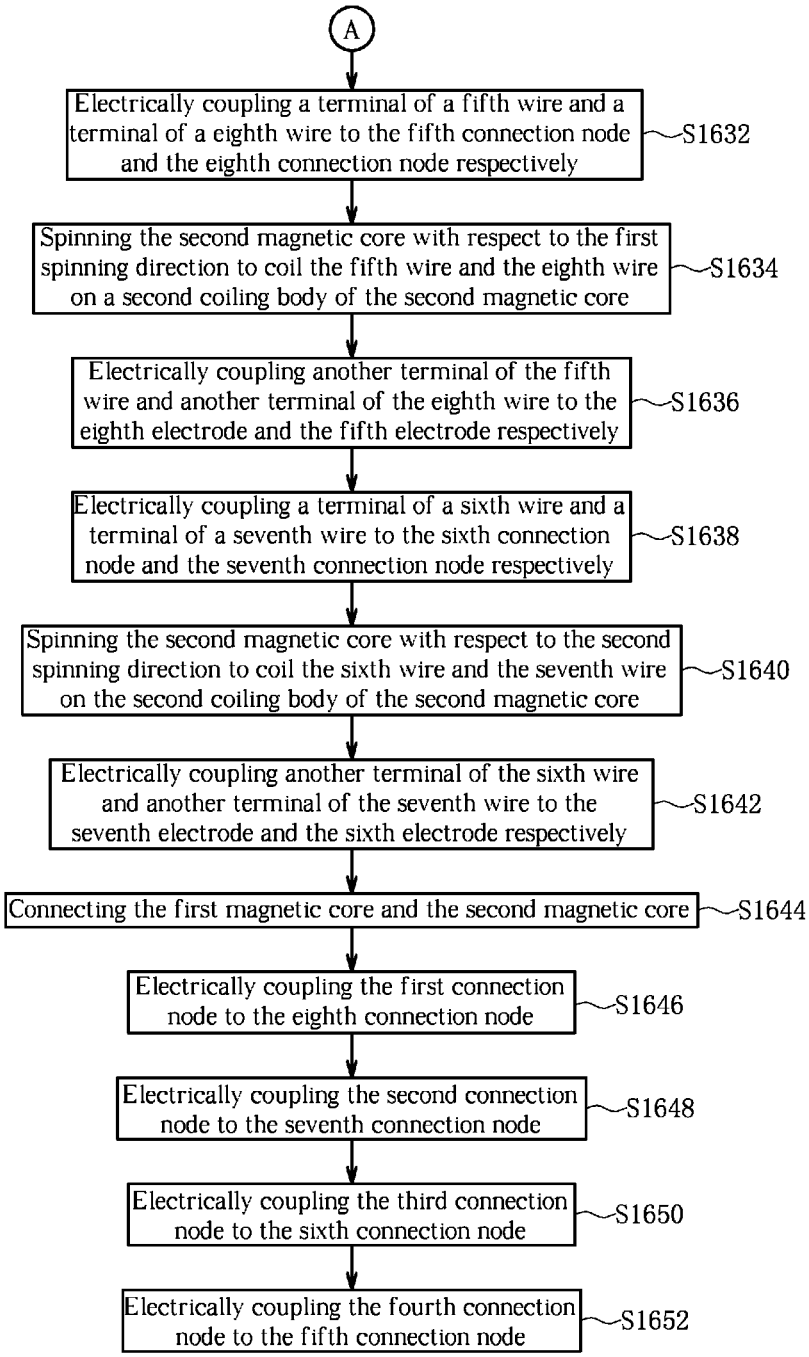

FIGS. 23 and 24 show a flowchart of a method 1600 for producing a magnetic element according to one embodiment of the present invention. The method 1600 includes steps S1612 through S1652.

S1612: disposing a first electrode, a second electrode, a third electrode and a fourth electrode on a first protruding portion of a first magnetic core;

S1614: disposing a fifth electrode, a sixth electrode, a seventh electrode and an eighth electrode on a fourth protruding portion of a second magnetic core;

S1616: disposing a first connection node, a second connection node, a third connection node and a fourth connection node on a second protruding portion of the first magnetic core;

S1618: disposing a fifth connection node, a sixth connection node, a seventh connection node and an eighth connection node on a third protruding portion of the second magnetic core;

S1620: electrically coupling a terminal of a first wire and a terminal of a fourth wire to the first electrode and the fourth electrode respectively;

S1622: spinning the first magnetic core with respect to a first spinning direction to coil the first wire and the fourth wire on a first coiling body of the first magnetic core;

S1624: electrically coupling another terminal of the first wire and another terminal of the fourth wire to the fourth connection node and the first connection node respectively;

S1626: electrically coupling a terminal of a second wire and a terminal of a third wire to the second electrode and the third electrode respectively;

S1628: spinning the first magnetic core with respect to a second spinning direction opposite to the first spinning direction to coil the second wire and the third wire on the first coiling body of the first magnetic core;

S1630: electrically coupling another terminal of the second wire and another terminal of the third wire to the third connection node and the second connection node respectively;

S1632: electrically coupling a terminal of a fifth wire and a terminal of a eighth wire to the fifth connection node and the eighth connection node respectively;

S1634: spinning the second magnetic core with respect to the first spinning direction to coil the fifth wire and the eighth wire on a second coiling body of the second magnetic core;

S1636: electrically coupling another terminal of the fifth wire and another terminal of the eighth wire to the eighth electrode and the fifth electrode respectively;

S1638: electrically coupling a terminal of a sixth wire and a terminal of a seventh wire to the sixth connection node and the seventh connection node respectively;

S1640: spinning the second magnetic core with respect to the second spinning direction to coil the sixth wire and the seventh wire on the second coiling body of the second magnetic core;

S1642: electrically coupling another terminal of the sixth wire and another terminal of the seventh wire to the seventh electrode and the sixth electrode respectively;

S1644: connecting the first magnetic core and the second magnetic core;

S1646: electrically coupling the first connection node to the eighth connection node;

S1648: electrically coupling the second connection node to the seventh connection node;

S1650: electrically coupling the third connection node to the sixth connection node; and S1652: electrically coupling the fourth connection node to the fifth connection node.

In steps S1612 to S1618, the second electrode can be disposed between the first electrode and the third electrode, and the third electrode can be disposed between the second electrode and the fourth electrode. The positions of the fifth electrode, the sixth electrode, the seventh electrode, and the eighth electrode can be corresponding to the positions of the fourth electrode, the third electrode, the second electrode, and the first electrode respectively. The position of the first connection node, the second connection node, the third connection node, and the fourth connection node can be corresponding to the positions of the fourth electrode, the third electrode, the second electrode, and the first electrode respectively. Also, the position of the fifth connection node, the sixth connection node, the seventh connection node, and the eighth connection node can be corresponding to the position of the fourth connection node, the third connection node, the second connection node, and the first connection node respectively. For example, in the magnetic element 200, the fourth electrode P4, the third electrode P3, the second electrode P2 and the first electrode P1 can be arranged sequentially on the first protruding portion 214 along a disposing direction K1 in parallel to the first soldering surface M1. The first connection node Q1, the second connection node Q2, the third connection node Q3 and the fourth connection node Q4 are arranged sequentially on the second protruding portion 216 along the disposing direction K1. The fifth electrode P5, the sixth electrode P6, the seventh electrode P7 and the eighth electrode P8 are arranged sequentially on the fourth protruding portion 226 along the disposing direction K1, and the eighth connection node Q8, the seventh connection node Q7, the sixth connection node Q6 and the fifth connection node Q5 are arranged sequentially on the third protruding portion 224 along the disposing direction K1 parallel to the second soldering surface M2.

Consequently, the method 1600 can be used to produce the magnetic element 200. In this case, the first magnetic core and the second magnetic core described in method 1600 can be corresponding to the first magnetic core 210 and the second magnetic core 220 in the magnetic element 200. The first electrode, the second electrode, the third electrode, the fourth electrode, the fifth electrode, the sixth electrode, the seventh electrode and the eighth electrode described in method 1600 can be corresponding to the first electrode P1, the second electrode P2, the third electrode P3, the fourth electrode P4, the fifth electrode P5, the sixth electrode P6, the seventh electrode P7 and the eighth electrode P8 in the magnetic element 200. The first connection node, the second connection node, the third connection node, the fourth connection node, the fifth connection node, the sixth connection node, the seventh connection node, and the eighth connection node described in method 1600 can be corresponding to the first connection node Q1, the second connection node Q2, the third connection node Q3, the fourth connection node Q4, the fifth connection node Q5, the sixth connection node Q6, the seventh connection node Q7, and the eighth connection node Q8 in the magnetic element 200 respectively. Also, the first wire, the second wire, the third wire, the fourth wire, the fifth wire, the sixth wire, the seventh wire and the eighth wire described in the method 1600 can be corresponding to the first wire W1, the second wire W2, the third wire W3, the fourth wire W4, the fifth wire W5, the sixth wire W6, the seventh wire W7 and the eighth wire W8 in the magnetic element 200 respectively.

In addition, the orders between the steps in the method 1600 are not limited to the orders shown in FIGS. 23 and 24. For example, in some embodiments of the present invention, the steps S1626 to S1630 can be executed before the steps S1620 to S1624 are executed. In this case, the first wire and the fourth wire will be coiled along the outer side of the second wire and the third wire. Similarly, the steps S1638 to S1642 can be executed before the steps S1632 to S1636. In this case, the fifth wire and the eighth wire will be coiled along the outer side of the sixth wire and the seventh wire. In addition, in the step S1644, the first magnetic core and the second magnetic core can be connected (glued) with a manner of standing side by side so the first protruding portion 214 and the second protruding portion 216 of the first magnetic core 210 would be connected to the fourth protruding portion 226 and the third protruding portion 224 of the second magnetic core 220 respectively.

In addition, in the steps S1612 to S1618 of the method 1600, the second electrode can be disposed between the first electrode and the fourth electrode, the fourth electrode can be disposed between the second electrode and the third electrode, the sixth electrode can be disposed between the fifth electrode and the eighth electrode, and the eighth electrode can be disposed between the sixth electrode and the seventh electrode. Also, the second connection node can be disposed between the first connection node and the fourth connection node, the fourth connection node can be disposed between the second connection node and the third connection node, the sixth connection node can be disposed between the fifth connection node and the eighth connection node, and the eighth connection node can be disposed between the sixth connection node and the seventh connection node. For example, in the magnetic element 200, the third electrode P3", the fourth electrode P4", the second electrode P2 and the first electrode P1 can be arranged sequentially on the first protruding portion 214 along a disposing direction K1 in parallel to the first soldering surface M1. The first connection node Q1, the second connection node Q2, the fourth connection node Q4" and the third connection node Q3" are arranged sequentially on the second protruding portion 216 along the disposing direction K1. The fifth electrode P5, the sixth electrode P6, the eighth electrode P8" and the seventh electrode P7" are arranged sequentially on the fourth protruding portion 226 along the disposing direction K1, and the seventh connection node Q7", the eighth connection node Q8", the sixth connection node Q6 and the fifth connection node Q5 are arranged sequentially on the third protruding portion 224 along the disposing direction K1 parallel to the second soldering surface M2.

Consequently, the method 1600 can be used to produce the magnetic element 1100. In this case, the first magnetic core and the second magnetic core described in method 1600 can be corresponding to the first magnetic core 210 and the second magnetic core 220 in the magnetic element 1100. The first electrode, the second electrode, the third electrode, the fourth electrode, the fifth electrode, the sixth electrode, the seventh electrode and the eighth electrode described in method 1600 can be corresponding to the first electrode P1, the second electrode P2, the third electrode P3", the fourth electrode P4", the fifth electrode P5, the sixth electrode P6, the seventh electrode P7" and the eighth electrode P8" in the magnetic element 1100. The first connection node, the second connection node, the third connection node, the fourth connection node, the fifth connection node, the sixth connection node, the seventh connection node, and the eighth connection node described in method 1600 can be corresponding to the first connection node Q1, the second connection node Q2, the third connection node Q3", the fourth connection node Q4", the fifth connection node Q5, the sixth connection node Q6, the seventh connection node Q7", and the eighth connection node Q8" in the magnetic element 1100 respectively. Also, the first wire, the second wire, the third wire, the fourth wire, the fifth wire, the sixth wire, the seventh wire and the eighth wire described in the method 1600 can be corresponding to the first wire W1, the second wire W2, the third wire W3, the fourth wire W4, the fifth wire W5, the sixth wire W6, the seventh wire W7 and the eighth wire W8 in the magnetic element 1100 respectively.

In summary, according to the magnetic elements and the method for producing the magnetic element provided by the present invention, the magnetic cores in the magnetic elements can be towards away from the system printed circuit board while the wires can be coiled on the two magnetic cores so that wires with greater diameter can be used to avoid the magnetic core from reaching high temperature while the self-inductance of the magnetic element can be preserved without changing the plane area and the footprint of the element. That is, the magnetic elements of the present invention can adopt wires with greater diameter than the wire used in prior art. Also, Comparing to the magnetic element of prior art, when using wires with same diameter and with same number of coils, the coiling space can be increase in the magnetic element of the present invention because the wires can be coiled on two magnetic cores in the magnetic element of the present invention while the wires can only be coiled on one single magnetic core in the prior art. In this case, the contact area between the protruding portions and the coiling bodies can also be increased, which helps to increase the equivalent magnetic permeability of the whole magnetic cores, and further helps to increase the inductance of the coils or the self-inductance of the magnetic element. Due to the advantages on the structures of the magnetic elements of the present invention, the magnetic element of the present invention requires smaller number of coils comparing to the prior art when having the same inductance or the self-inductance. Therefore, the copper loss and the high frequency transmission loss can be reduced and the high frequency characteristics can be enhanced.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A magnetic element, comprising:

a first magnetic core comprising:

a first coiling body;

a first protruding portion connected to a first terminal of the first coiling body and having a first soldering surface; and a second protruding portion connected to a second terminal of the first coiling body;

a second magnetic core comprising:

a second coiling body disposed in parallel to the first coiling body;

a third protruding portion connected to a first terminal of the second coiling body and disposed adjacent to the second protruding portion; and a fourth protruding portion connected to a second terminal of the second coiling body, disposed adjacent to the first protruding portion, and having a second soldering surface in parallel to the first soldering surface;

a plurality of wires, each coiled on the first coiling body or the second coiling body;

a plurality of electrodes, each disposed on the first soldering surface of the first protruding portion or the second soldering surface of the fourth protruding portion and configured to couple to an external system printed circuit board; and a plurality of connection nodes, each disposed on the second protruding portion and the third protruding portion, each connection node of the plurality of connection nodes disposed on the second protruding portion being coupled to a corresponding connection node of the plurality of the connection nodes disposed on the third protruding portion;

wherein:

an extension direction of the first coiling body is towards away from the first soldering surface, and an extension direction of the second coiling body is towards away from the second soldering surface;

the plurality of wires are coiled on the first coiling body along the extension direction of the first coiling body or coiled on the second coiling body along the extension direction of the second coiling body; and the first coiling body and the second coiling body both comprise magnetically conductive material.

2. The magnetic element of claim 1, wherein the first magnetic core and the second magnetic core are H-shaped magnetic cores.

3. The magnetic element of claim 1, wherein the extension direction of the first coiling body is substantially perpendicular to the first soldering surface, and the extension direction of the second coiling body is substantially perpendicular to the second soldering surface.

4. The magnetic element of claim 1, wherein the first coiling body, the second coiling body, the first protruding portion, the second protruding portion, the third protruding portion and the fourth protruding portion are composed of Mn—Zn Ferrite, Ni—Zn Ferrite and/or ferrite.

5. The magnetic element of claim 1, wherein:

the plurality of electrodes comprises a first electrode to an eighth electrode, the first electrode to the fourth electrode are disposed on the first soldering surface of the first protruding portion, and the fifth electrode to the eighth electrode are disposed on the second soldering surface of the fourth protruding portion;

the plurality of connection nodes comprises a first connection node to an eighth connection node, the first connection node to the fourth connection node are disposed on the second protruding portion, and the fifth connection node to the eighth connection node are disposed on the third protruding portion; and the plurality of wires comprises:

a first wire coiled on the first coiling body and electrically coupled to the first electrode and the fourth connection node;

a second wire coiled on the first coiling body and electrically coupled to the second electrode and the third connection node;

a third wire coiled on the first coiling body and electrically coupled to the third electrode and the second connection node;

a fourth wire coiled on the first coiling body and electrically coupled to the fourth electrode and the first connection node;

a fifth wire coiled on the second coiling body and electrically coupled to the fifth connection node and the eighth electrode;

a sixth wire coiled on the second coiling body and electrically coupled to the sixth connection node and the seventh electrode;

a seventh wire coiled on the second coiling body and electrically coupled to the seventh connection node and the sixth electrode; and an eighth wire coiled on the second coiling body and electrically coupled to the eighth connection node and the fifth electrode.

6. The magnetic element of claim 5, wherein the first connection node is electrically coupled to the eighth connection node, the second connection node is electrically coupled to the seventh connection node, the third connection node is electrically coupled to the sixth connection node, and the fourth connection node is electrically coupled to the fifth connection node.

7. The magnetic element of claim 6, wherein the third electrode is electrically coupled to the fourth electrode and the seventh electrode is electrically coupled to the eighth electrode.

8. The magnetic element of claim 7, wherein an input current flowing through the first wire, the second wire, the fifth wire and the sixth wire generates a first magnetic field, the first magnetic field induces an induced current flowing through the third wire, the fourth wire, the seventh wire, and the eighth wire to generate a second magnetic field, and a magnetic flux of the first magnetic field is pointing to an opposite direction of a magnetic flux of the second magnetic field.

9. The magnetic element of claim 8, wherein the magnetic flux of the first magnetic field and the magnetic flux of the second magnetic field pass through the first coiling body and the second coiling body along opposite directions.

10. The magnetic element of claim 7, wherein the first electrode is a positive input terminal of the magnetic element, the second electrode is a negative input terminal of the magnetic element, the fifth electrode is a negative output terminal of the magnetic element, and the sixth electrode is a positive output terminal of the magnetic element.

11. The magnetic element of claim 10, wherein the first wire and the fourth wire are coiled on the first coiling body along a first coiling direction, the second wire and the third wire are coiled on the first coiling body along a second coiling direction opposite to the first coiling direction, the fifth wire and the eighth wire are coiled on the second coiling body along the first coiling direction, and the sixth wire and the seventh wire are coiled on the second coiling body along the second coiling direction.

12. The magnetic element of claim 10, wherein the first wire and the fourth wire are coiled along an inner side or an outer side of the second wire and the third wire, and the sixth wire and the seventh wire are coiled along an inner side or an outer side of the fifth wire and the eighth wire.

13. The magnetic element of claim 10, wherein the first electrode is adjacent to the second electrode, the third electrode is adjacent to the fourth electrode, the seventh electrode is adjacent to the eighth electrode, and the fifth electrode is adjacent to the sixth electrode.

14. The magnetic element of claim 5, wherein:

the third electrode, the fourth electrode, the second electrode and the first electrode are arranged sequentially on the first protruding portion along a disposing direction in parallel to the first soldering surface;

the first connection node, the second connection node, the fourth connection node and the third connection node are arranged sequentially on the second protruding portion along the disposing direction;

the seventh connection node, the eighth connection node, the sixth connection node and the fifth connection node are arranged sequentially on the third protruding portion along the disposing direction;

the fifth electrode, the sixth electrode, the eighth electrode and the seventh electrode are arranged sequentially on the fourth protruding portion along the disposing direction; and the disposing direction extends from a side of a protruding portion of the protruding portions to an opposite side of the protruding portion.

15. The magnetic element of claim 1, wherein:

the plurality of electrodes comprises a first electrode to a fourth electrode, the first electrode and the second electrode are disposed on the first soldering surface of the first protruding portion, and the third electrode and the fourth electrode are disposed on the second soldering surface of the fourth protruding portion;

the plurality of connection nodes comprises a first connection node to a fourth connection node, the first connection node and the second connection node are disposed on the second protruding portion, and the third connection node and the fourth connection node are disposed on the third protruding portion;

the plurality of wires comprises:

a first wire coiled on the first coiling body and electrically coupled to the first electrode and the first connection node;

a second wire coiled on the first coiling body and electrically coupled to the second electrode and the second connection node;

a third wire coiled on the second coiling body and electrically coupled to the third connection node and the third electrode; and a fourth wire coiled on the second coiling body and electrically coupled to the fourth connection node and the fourth electrode;

the first connection node is electrically coupled to the third connection node; and the second connection node is electrically coupled to the fourth connection node.

16. The magnetic element of claim 1, wherein:

the first protruding portion and the fourth protruding portion are connected by adhesive while the second protruding portion and the third protruding portion are connected by adhesive, combining the first magnetic core and the second magnetic core.

17. The magnetic element of claim 1, wherein:

the plurality of connection nodes disposed on the second protruding portion and the plurality of connection nodes disposed on the third protruding portion are not to contact with a soldering face of the external system printed circuit board.

* * * * *